US009845745B2

(12) United States Patent
Dudar

(10) Patent No.: US 9,845,745 B2
(45) Date of Patent: Dec. 19, 2017

(54) EVAP SYSTEM WITH VALVE TO IMPROVE CANISTER PURGING

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 211 days.

(21) Appl. No.: 14/794,474

(22) Filed: Jul. 8, 2015

(65) Prior Publication Data

US 2017/0009673 A1 Jan. 12, 2017

(51) Int. Cl.

| | |
|---|---|
| ***F02D 41/00*** | (2006.01) |
| ***F02M 25/08*** | (2006.01) |
| *F02D 41/14* | (2006.01) |

(52) U.S. Cl.

CPC ..... *F02D 41/004* (2013.01); *F02D 41/0045* (2013.01); *F02M 25/0836* (2013.01); *F02D 41/1439* (2013.01); *F02D 41/1454* (2013.01); *F02D 2200/0404* (2013.01); *F02D 2200/0406* (2013.01); *F02M 25/0854* (2013.01)

(58) Field of Classification Search

CPC ..... F02M 25/08; F02M 25/0836; F02M 25/0872; F02M 25/089; F02M 2025/0845; F02D 41/003; F02D 41/0032; F02D 41/004; F02D 41/0045

See application file for complete search history.

(56) References Cited

U.S. PATENT DOCUMENTS

| | | | | |
|---|---|---|---|---|
| 4,750,923 | A | 6/1988 | Haruta et al. | |
| 5,277,167 | A * | 1/1994 | DeLand | F02M 25/0836 123/518 |
| 5,638,797 | A | 6/1997 | Kim | |
| 6,202,632 | B1 | 3/2001 | Geiger et al. | |
| 6,230,693 | B1 | 5/2001 | Meiller et al. | |
| 7,097,697 | B2 | 8/2006 | Nakamura et al. | |
| 7,233,845 | B2 | 6/2007 | Veinotte | |
| 7,299,787 | B2 | 11/2007 | Sasaki et al. | |
| 7,503,320 | B2 | 3/2009 | Collet | |
| 8,181,631 | B2 | 5/2012 | Bohr et al. | |
| 8,191,525 | B2 | 6/2012 | Born et al. | |
| 8,246,729 | B2 | 8/2012 | Defilippi et al. | |

(Continued)

FOREIGN PATENT DOCUMENTS

| | | |
|---|---|---|
| EP | 1688610 A2 | 8/2006 |
| WO | 2014088530 A1 | 6/2014 |

OTHER PUBLICATIONS

Flow in Pipes, printed Nov. 4, 2004 by LPS, Chapter 8, pp. 321-343.*

*Primary Examiner* — Erick Solis
*Assistant Examiner* — Anthony L Bacon
(74) *Attorney, Agent, or Firm* — James Dottavio; McCoy Russell LLP

(57) ABSTRACT

Systems and methods are provided for an evaporative emissions control system. In one example, a system for an engine may comprise a fuel vapor canister, a mixing valve positioned in a fresh air line upstream of the vapor canister, and an actuator physically coupled to the mixing valve for adjusting a position of the mixing valve to increase turbulence in air entering the vapor canister. The position of the mixing valve may be adjusted to increase an amount of turbulence in air entering the fuel vapor canister.

20 Claims, 5 Drawing Sheets

(56) References Cited

U.S. PATENT DOCUMENTS

| | | | | |
|---|---|---|---|---|
| 8,529,676 | B2 | 9/2013 | Segiura | |
| 8,590,514 | B2 | 11/2013 | Pursifull | |
| 8,783,231 | B2 | 7/2014 | Leone | |
| 2003/0015156 | A1* | 1/2003 | Leone | F02D 13/0226 123/90.15 |
| 2004/0094133 | A1* | 5/2004 | Lingenhult | F02M 25/0809 123/519 |
| 2010/0126477 | A1* | 5/2010 | Reddy | F02M 25/0836 123/520 |
| 2012/0234303 | A1 | 9/2012 | Born et al. | |
| 2013/0000610 | A1 | 1/2013 | Yamamoto et al. | |
| 2013/0152905 | A1 | 6/2013 | Woods et al. | |
| 2015/0021407 | A1 | 1/2015 | Dong et al. | |

* cited by examiner

EVAP SYSTEM WITH VALVE TO IMPROVE CANISTER PURGING

FIELD

The present disclosure relates to an evaporative emission control (EVAP) system in a vehicle system.

BACKGROUND AND SUMMARY

Vapor storage canisters, such as carbon canisters, are used in vehicles to reduce vapor emissions caused by temperature and/or pressures changes in the fuel tank. For instance, temperature shifts in the fuel tank which may be caused by diurnal cycles, heat rejection from underbody components such as an exhaust pipe, and/or hot return fuel from the engine can generate fuel vapors in the fuel delivery system. Fuel vapor may also be generated during refueling because of air entrainment with liquid fuel, turbulence, and temperature differences between tank fuel and fresh fuel. Furthermore for hybrid vehicles, the fuel tank is sealed at high pressure. This pressure is released rapidly during refueling. This pressure change can also cause vapor generation. The fuel vapors may leak or permeate from the fuel tank if not properly sequestered. Therefore, in some vehicles fuel vapors are routed to carbon canisters for temporary storage to reduce emissions. The fuel vapors may be subsequently purged during certain operating conditions to prevent overfilling of the vapor storage canister. During purging operation, fresh air may be introduced into the canister causing desorption of the fuel vapors from the carbon in the canister. Then, the mixture of air and fuel vapor is routed into engine via an intake system where they are combusted.

U.S. Pat. No. 8,246,729 discloses a fuel vapor storing device having a tubular diffuser with plurality of openings providing air into the device during purging. However, the fuel vapor storing device disclosed in U.S. Pat. No. 8,246,729 does not provide a desired amount of flow distribution in the device during purging. Specifically, the tubular diffuser may not generate flow patterns which evenly distribute the airflow through the device when purged. The tubular/annular diffuser described in aforementioned patent also increases pressure drop across canister because of narrow flow passages and flow turning. As a result, the desorption rate of fuel vapor into the intake air may be decreased during periods of high inlet airflow. Consequently, there may be trade-offs between purging efficiency (e.g., the amount of fuel vapor purged from the canister per volumetric airflow) and the flow-rate of air during purging. As a result, a desired amount of fuel vapor may not be purged from the device in a desired period of time, preventing the device from being completely purged. Consequently, the device may reach maximum vapor storage, thereby increasing fuel vapor emission from the vehicle. This may be particularly problematic in plug-in electric hybrid vehicles (PHEV) where high purge rates are desired due to the limited window of engine combustion operation in the vehicle.

The inventors herein have recognized the above issues and developed systems and method for addressing the issues. In particular, a mixing valve is disclosed which may be positioned upstream of a fuel vapor canister for improving purging efficiency of the canister. In one example, a system for an engine may comprise a fuel vapor canister, a mixing valve positioned in a fresh air line upstream of the vapor canister, and an actuator physically coupled to the mixing valve for adjusting a position of the mixing valve to increase turbulence in air entering the vapor canister. In some examples, the mixing valve may be adjustable between a closed first position where air does not flow past the mixing valve, and an open second position where air does flow past the mixing valve, where an amount of turbulence in air entering the vapor canister may increase with increasing deflection of the mixing valve towards the closed first position and away from the open second position.

The position of the mixing valve may be adjusted based on an amount of fuel vapor desorption from the fuel vapor canister, where the amount of vapor desorption may be determined based on outputs from an oxygen sensor positioned downstream of the canister between the canister and an intake manifold of the engine. Specifically, the position of the mixing valve may be adjusted to increase turbulence in air entering the vapor canister in response to decreases in the amount of vapor desorption. In other examples, the position of the mixing valve may be additionally or alternatively be adjusted to increase turbulence in air entering the canister in response to one or more of decreases in an intake manifold vacuum, opening of a throttle, and decreases in an airflow rate through the canister.

In another representation, an engine system may comprise an engine including an intake manifold, a fuel vapor canister fluidically coupled to the intake manifold via a purge line for purging fuel vapors thereto, a fresh air line fluidly coupled to the canister and open to ambient air for drawing said ambient air into the canister during purging of the canister, the fresh air line comprising two parallel conduits fluidically separated by a wall, a first mixing valve positioned in one of the conduits of the fresh air line, and a controller with computer readable instructions for adjusting a position of the mixing valve during purging of the canister to increase flow uniformity in the canister in response to outputs received from an oxygen sensor positioned in the purge line. In a first example of the engine system, the engine system may further comprise an actuator which may be in electrical communication with the controller and may be physically coupled to the mixing valve for adjusting the position of the mixing valve in response to signals received from the controller. In a second example of the engine system, the engine system may include one or more or each of a second mixing valve positioned in the purge line downstream of the canister, for increasing an amount of turbulence in air entering the intake manifold from the purge line.

In this way, an amount of fuel vapor desorption and therefore canister purging efficiency may be increased by adjusting a position of a mixing valve coupled in a fresh air line upstream of a fuel vapor canister. The above advantages and other advantages, and features of the present description will be readily apparent from the following Detailed Description when taken alone or in connection with the accompanying drawings.

It should be understood that the above summary is provided to introduce a selection of concepts in simplified form. These concepts are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

Figure 1A:
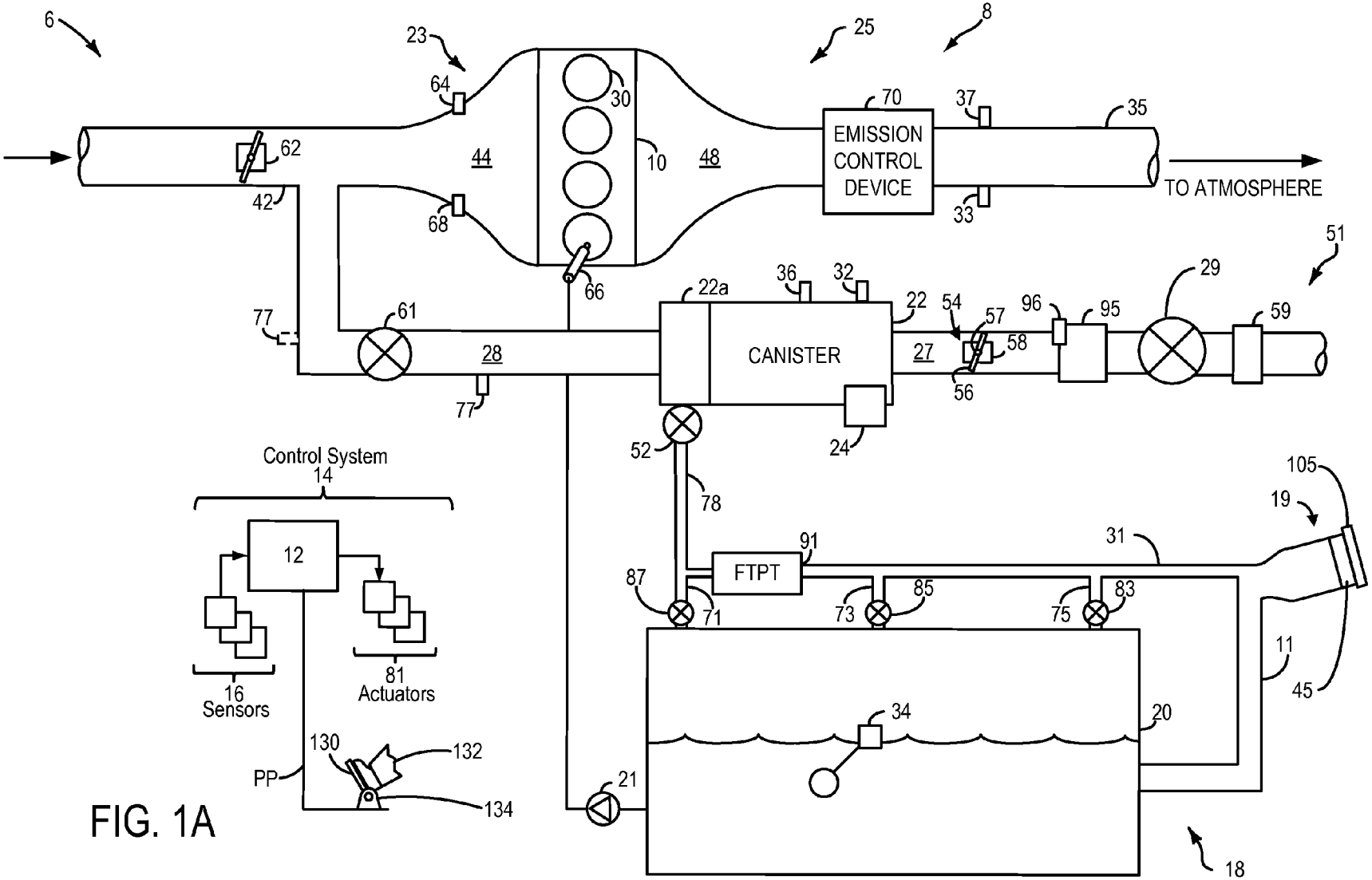
FIG. 1A shows a schematic depiction of a vehicle including a mixing valve in an emission control device.
Figure 1B:
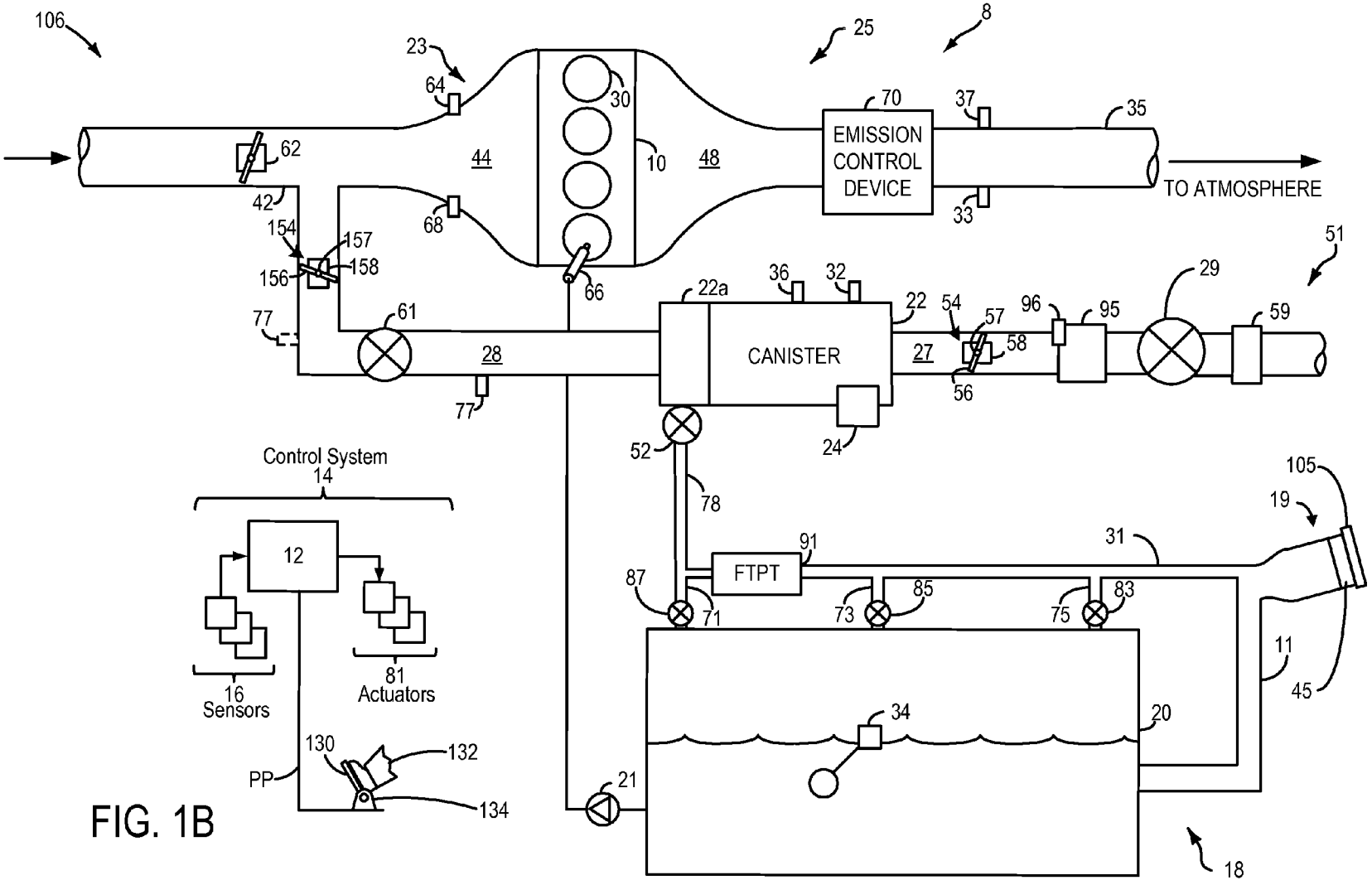
FIG. 1B shows another schematic depiction of an example vehicle including two mixing valves.

The following detailed description relates to systems and methods for improving purging of a fuel vapor canister included in an engine system, such as the engine system of FIGS. 1A and 1B. The fuel vapor canister may be coupled to an engine intake via a canister purge valve. Stored fuel vapors in the fuel vapor canister may be purged to the intake by opening of the canister purge valve, and a canister vent valve. Thus, during purging operation of the canister, the purge valve and vent valve may be opened to allow fresh, ambient air to be drawn through the canister via vacuum generated in an intake manifold. As air flows through the canister, it may come into contact with fuel vapors stored in the canister, and may cause the fuel vapors to be desorbed and purged from the canister.

Figure 2B:
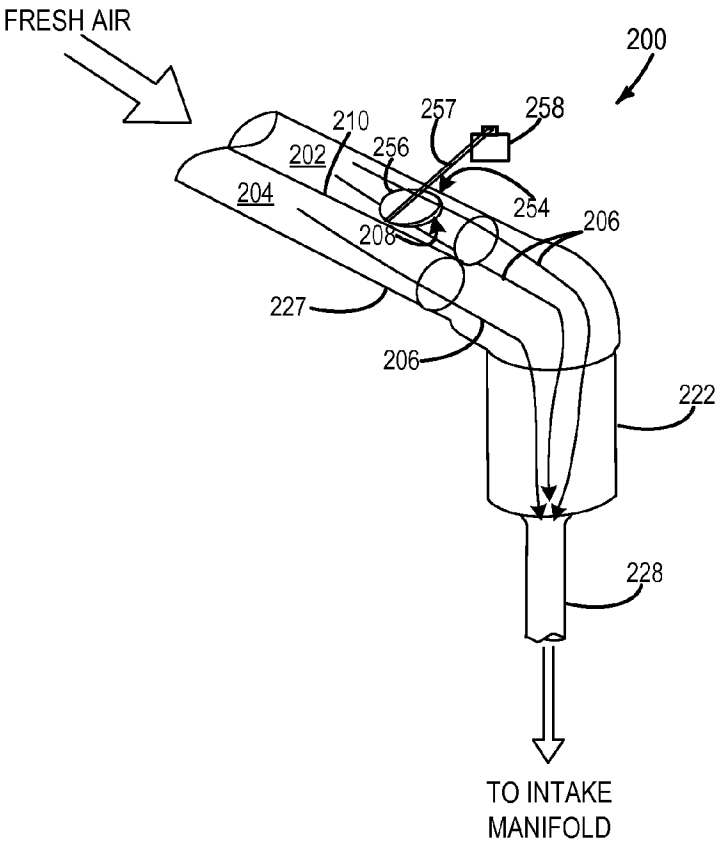
FIG. 2B shows an example mixing valve in an open second position.
Figure 2A:
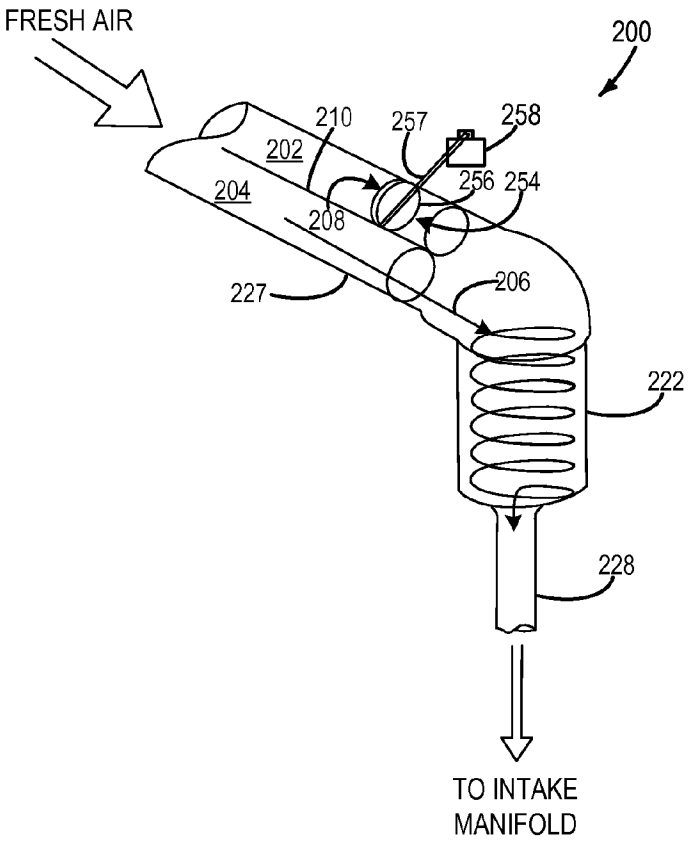
FIG. 2A shows an example mixing valve in a closed first position.
Figure 3:
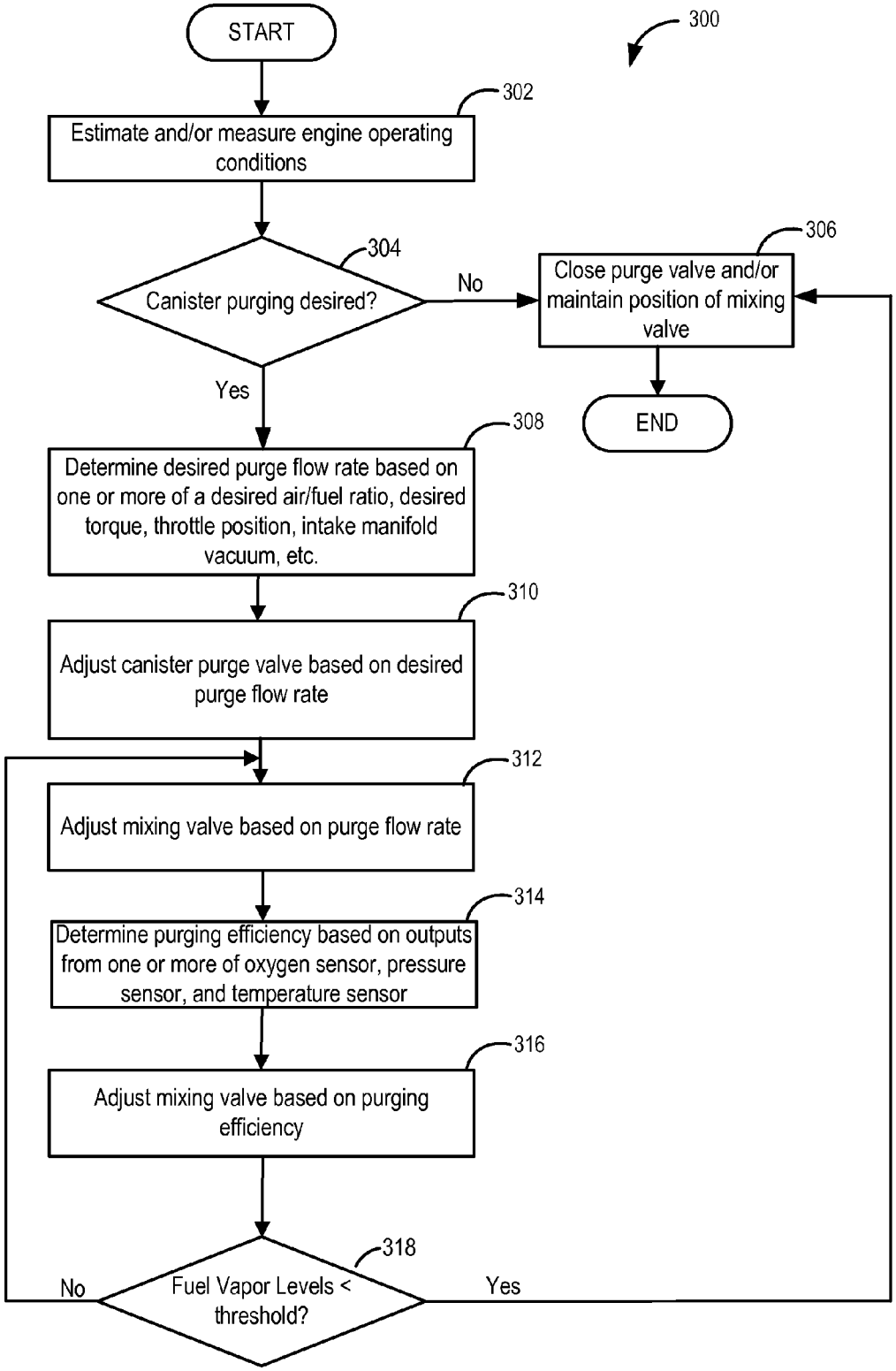
FIG. 3 shows a flow chart of an example method for adjusting a mixing valve during purging of a fuel vapor canister.
Figure 4:
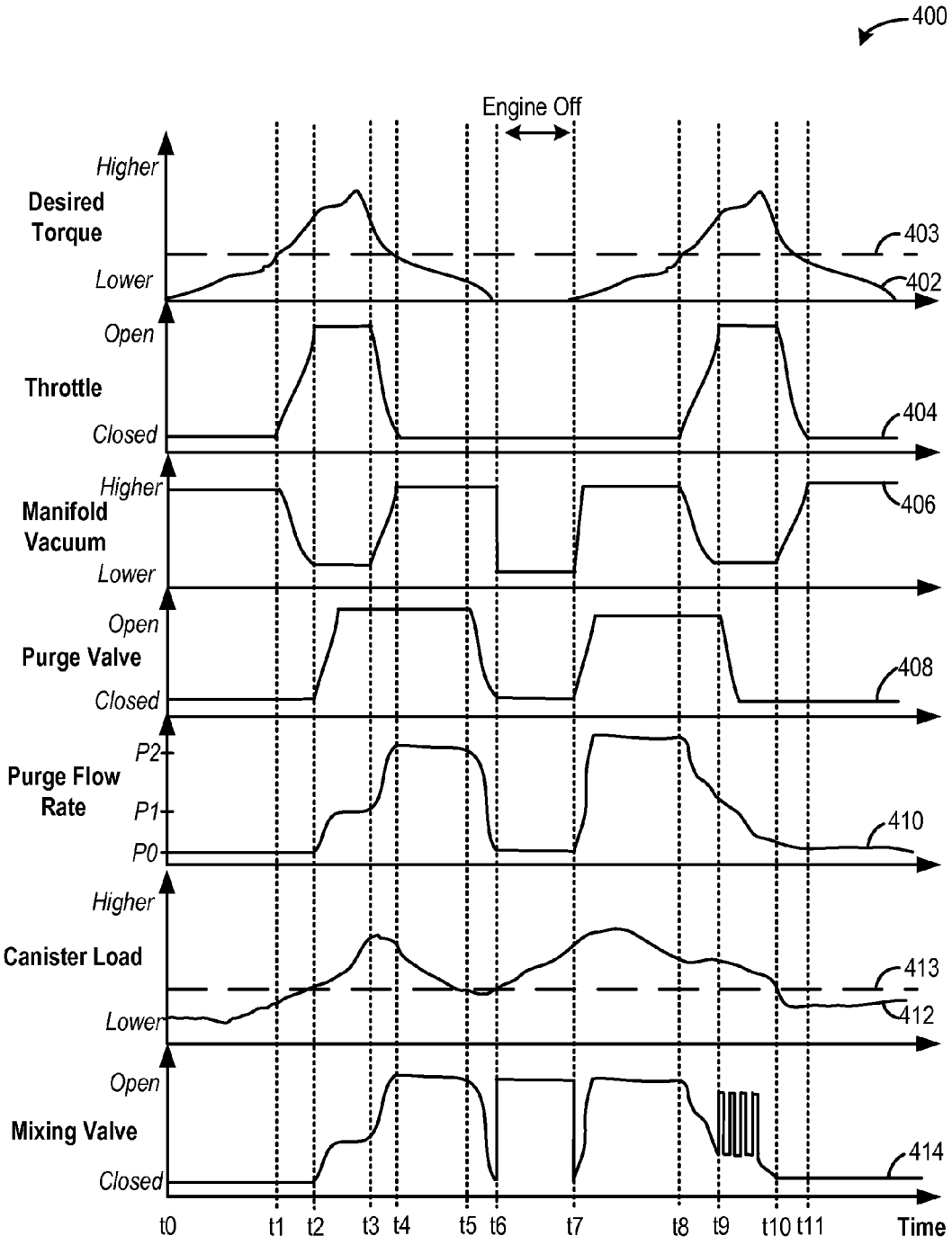
FIG. 4 is a graph depicting example purging operations in an engine system.

However, airflow through the canister may be uneven. Thus, air flowing through the canister may be restricted to only a portion of the canister, and air may not reach all areas of the canister during purging operation. As such, the canister may not be fully purged of fuel vapors. A mixing valve, as shown in FIGS. 2A and 2B, may be positioned upstream of the canister to increase turbulence in the air entering the canister, and therefore encourage commingling and/or dispersion of air in the canister. An example method for adjusting the mixing valve during purging operation is shown in FIG. 3. FIG. 4, shows how the mixing valve may be adjusted during engine operation based on engine operating parameters such as intake manifold vacuum, throttle position, etc.

The mixing valve may be adjusted to increase fuel vapor desorption and canister purging efficiency by increasing the turbulence in the air entering the canister. This may be particularly useful in vehicles which may have a small window for purge operation, such as hybrid type vehicles.

Referring now to FIG. 1A, a schematic depiction of a vehicle system 6 is shown. The vehicle system 6 includes an engine system 8 coupled to an emissions control system 51 and a fuel system 18. Emission control system 51 includes a fuel vapor container or canister 22 which may be used to capture and store fuel vapors. In some examples, vehicle system 6 may be a hybrid electric vehicle system.

The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The throttle 62 may be in electrical communication with the controller 12, and as such may be an electronically controlled throttle. Said another way, the controller 12, may send signals to an actuator of the throttle 62, for adjusting the position of the throttle 62. The position of the throttle 62 may be adjusted based on one or more of a desired engine torque, desired air/fuel ratio, barometric pressure, etc. Further, in examples where in the intake includes a compressor such as a turbocharger or supercharger, the position of the throttle 62 may be adjusted based on an amount of boost in the intake passage 42.

The controller 12 may also estimate a mass airflow (MAF) in the intake manifold 44 based on outputs from one or more sensors positioned in the intake manifold 44. In one examples, manifold air pressure sensor 64 may be coupled to intake manifold 144 for providing a signal regarding manifold air pressure (MAP) to controller 12. However, in other examples, an estimate of the manifold airflow (MAF) may be obtained from a MAF sensor 68 coupled to intake manifold 44, and communicated with controller 112. In other examples, the controller 12 may estimate the MAF based on outputs from both the sensors 64 and 68. Additionally or alternatively, the controller 12 may estimate the MAF based on a position of the throttle 62.

In this way, the controller 12 may send signals to the throttle 62, for adjusting the position of the throttle 62 based on a difference between a desired engine torque and an estimated engine torque, and/or a difference between a desired MAF and the estimated MAF. Specifically, the throttle 62 may be adjusted to a more open position, so that MAF in intake manifold 44 increases in response to one or more of estimated engine torque being less than the desired engine torque and the estimated MAF being less than the desired MAF. The throttle 62 may be adjusted between a fully closed first position and a fully open second position, and/or any position there-between, where an opening formed between edges of the throttle 62 and the intake passage 42 increases with increasing deflection of the throttle 62 away from the closed first position towards the open second position.

The engine exhaust 25 includes an exhaust manifold 48 leading to an exhaust passage 35 that routes exhaust gas to the atmosphere. The atmosphere includes the ambient environment surrounding the vehicle, which may have an ambient temperature and pressure (such as barometric pressure). The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

The vehicle system 6 may be controlled by controller 12 and/or input from a vehicle operator 132 via an input device 130. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130. In response to the desired engine torque, the controller 12, may adjust the position of throttle 62, and/or injectors of engine 10 to achieve the desired engine torque while maintaining a desired air/fuel ratio.

Fuel system 18 may include a fuel tank 20 coupled to a fuel pump system 21. The fuel pump system 21 may include one or more pumps for pressurizing fuel delivered to the injectors of engine 10, such as the example injector 66 shown. While only a single injector 66 is shown, additional injectors are provided for each cylinder. It will be appreciated that fuel system 18 may be a return-less fuel system, a return fuel system, or various other types of fuel system. Fuel tank 20 may hold a plurality of fuel blends, including fuel with a range of alcohol concentrations, such as various gasoline-ethanol blends, including E10, E85, gasoline, etc., and combinations thereof. A fuel level sensor 34 located in fuel tank 20 may provide an indication of the fuel level ("Fuel Level Input") to controller 12. As depicted, fuel level sensor 34 may comprise a float connected to a variable resistor. Alternatively, other types of fuel level sensors may be used.

Vapors generated in fuel system 18 may be routed to an evaporative emissions control (EVAP) system 51, which includes a fuel vapor canister 22 via vapor recovery line 31, before being purged to the engine intake 23. Vapor recovery line 31 may be coupled to fuel tank 20 via one or more conduits and may include one or more valves for isolating the fuel tank during certain conditions. For example, vapor recovery line 31 may be coupled to fuel tank 20 via one or more or a combination of conduits 71, 73, and 75.

Further, in some examples, one or more fuel tank vent valves may be included in conduits 71, 73, or 75. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 71 may include a grade vent valve (GVV) 87, conduit 73 may include a fill limit-venting valve (FLVV) 85, and conduit 75 may include a grade vent valve (GVV) 83. Further, in some examples, recovery line 31 may be coupled to a fuel filler system, herein also termed a refueling assembly 19. In some examples, fuel filler system may include a fuel cap 105 for sealing off the fuel filler system from the atmosphere. However, in other examples, the fuel filler system may be a capless system and may not include fuel cap 105. Refueling assembly 19 is coupled to fuel tank 20 via a fuel fill line 11.

Further, refueling assembly 19 may include refueling lock 45. In some embodiments, refueling lock 45 may be a fuel cap locking mechanism. The fuel cap locking mechanism may be configured to automatically lock the fuel cap in a closed position so that the fuel cap cannot be opened. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling assembly 19 may be a capless design. In such embodiments, refueling access seal (fuel cap 105) may be considered a refueling access door located in the body panel of the vehicle and refueling lock 45 may lock the refueling access door.

Emissions control system 51 may include one or more emissions control devices, such as one or more fuel vapor canisters 22 filled with an appropriate adsorbent. The canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 51 may further include a canister ventilation path or fresh air line 27 which may route gases out of the canister 22 to the atmosphere when storing, or trapping, fuel vapors from fuel system 18.

Canister 22 may include a buffer **22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22** such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Fresh air line 27 may also allow fresh air to be drawn into canister 22 when purging stored fuel vapors from fuel system 18 to engine intake 23 via purge line 28 and purge valve 61. For example, purge valve 61 may be normally closed but may be opened during certain conditions so that vacuum from engine intake manifold 44 is provided to the fuel vapor canister 12 for purging. In some examples, fresh air line 27 may include an air filter 59 disposed therein upstream of a canister 22.

Flow of air and vapors between canister 22 and the atmosphere may be regulated by a canister vent valve 29. Vapor blocking valve (VBV) 52 may control the flow of gasses from the fuel tank 20 to the canister 22. Specifically, VBV 52 may be positioned between the fuel tank and the fuel vapor canister 22, which may be fluidically coupled via conduit 78. In some examples, VBV 52 may be located within canister 22. VBV 52 may be a normally closed valve, that when opened, allows for the venting of fuel vapors from fuel tank 20 to canister 22. Canister vent valve 29 may be a normally open valve, so that when valve 29 is open, vapor blocking valve 52 (VBV) may control venting of fuel tank 20 with the atmosphere. Fuel vapors stored in the canister 22 from the fuel tank 20 may then be purged to engine intake 23 via canister purge valve 61.

Thus, during purging of the canister 22, purge valve 61 and vent valve 29 may be opened, so that fresh air may be drawn into fresh air line 27 and through canister 22 via the vacuum generated in the intake manifold 44. In this way, purging of the canister 22, may comprise opening purge valve 61 and vent valve 29, and flowing fresh air from outside fresh air line 27, into the EVAP system 51 via fresh air line 27. Further, during purging of the canister 22, fresh air may flow through fresh air line 27, towards the canister 22, through canister 22, through line 28, en route to the intake manifold 44. Additionally, in some examples, valve 52 may be closed during purging. However, in other examples, valve 52 may be opened during purging of the canister 22. In this way, the fuel vapors stored in the canister 22 may be desorbed from the canister 22 and purged to the intake manifold 44 by opening valves 29 and 61, and flowing fresh air through the canister 22.

A temperature sensor 32 may be coupled to and/or within canister 22. As fuel vapor is adsorbed by the absorbent in the canister, heat is generated (heat of adsorption). Likewise, as fuel vapor is desorbed by the adsorbent in the canister, heat is consumed. In this way, the adsorption and desorption of fuel vapors by the canister 22 may be monitored and estimated based on temperature changes within the canister. Specifically, the temperature sensor 32 may be in electrical communication with the controller 12 for sending signals thereto. Fuel vapor levels in the canister 22 may therefore be estimated by the controller 12 based on outputs received from the temperature sensor 32.

Additionally or alternatively, a pressure sensor 36 may be coupled to and/or within canister 22. As fuel vapor is adsorbed by the adsorbent in the canister, pressure in the canister may increase. Conversely, as the fuel vapor is desorbed by the adsorbent in the canister, the pressure in the canister may decrease. In this way, the adsorption and desorption of fuel vapors by the canister 22 may be monitored and estimated based on pressure changes within the canister 22. Specifically, the pressure sensor 36 may be in electrical communication with the controller 12 for sending signals thereto. Fuel vapor levels in the canister 22 may therefore be estimated by the controller 12 based on outputs received from the pressure sensor 36.

Further, an oxygen sensor 77, may be positioned downstream of the canister 22 for measuring and/or estimating an amount of fuel vapors in the canister 22. In one example, the oxygen sensor 77 may be positioned in purge line 28 downstream of canister 22 but upstream of purge valve 61. However, in other examples, the oxygen sensor 77 may be positioned elsewhere in the EVAP system 51, such as downstream of the purge valve 61, between the purge valve 61 and the intake manifold 44, as shown by the dotted lines in FIG. 1A. The oxygen sensor 77 may be in electrical communication with controller 12 for sending outputs thereto. As such, the controller 12, may estimate an amount of oxygen the purge line 28 based on outputs received from the oxygen sensor 77. As such, the oxygen sensor 77 may be any variable voltage (VVs) sensor capable of measuring oxygen levels/concentrations such as a UEGO, HEGO, EGO, etc.

Thus, outputs from the oxygen sensor 77 may be used to determine an amount of fuel vapors in the canister 22 and/or a purging efficiency of the canister 22. Specifically, outputs from the oxygen sensor 77 when the purge valve 61 and canister vent valve 29 are open, may be compared to outputs of the oxygen sensor 77 when one or more of the purge valve 61 and vent valve 29 are closed. Said another way, outputs from the oxygen sensor 77 from when the canister 22 is being purged and air is flowing through the canister 22 (e.g., when valves 29 and 61 are open) may be compared to outputs from the oxygen sensor 77 when the canister 22 is not being purged and air is not flowing through the canister 22. Thus, outputs from the sensor 77 when the canister is not being purged may be used as a baseline, which outputs from the sensor 77 during purging operation may be compared to. Differences in the outputs from oxygen sensor 77, and therefore differences in the oxygen concentration of gasses flowing from the canister 22 may be used to estimate an amount of fuel vapor being purged from the canister 22. As such, an amount of change in the oxygen concentration estimated based on outputs from sensor 77 from when the canister is not purged to when the canister is being purged may be substantially the same as an amount of fuel vapors flowing past the oxygen sensor 77. In this way, an amount of fuel vapors being purged from the canister 22, and/or a fuel vapor level in the canister 22, may be estimated based on outputs from the oxygen sensor 77.

Specifically, the oxygen concentration of gasses flowing past the oxygen sensor 77 may be higher when the canister 22 is not being purged, than when it is being purged, due to the absence of fuel vapors when the canister 22 is not being purged. Thus, as the canister 22 is purged, fuel vapors are desorbed by the canister 22, and flow past the oxygen sensor 77. In this way, the relative amount of oxygen in the gasses flowing past the oxygen sensor 77 may decrease. Changes in the oxygen concentration may be used to infer an amount of fuel vapors in the gasses flowing past the oxygen sensor, and therefore an amount of fuel vapors being purged from the canister 22.

It should be appreciated that in some examples, fuel vapor levels in the canister 22, and/or an amount of fuel vapors flowing from the canister 22 may be estimated based on outputs from only oxygen sensor 77. However, in other examples, fuel vapor levels in the canister 22, and/or an amount of fuel vapors flowing from the canister 22 may be estimated based on outputs from only temperature sensor 32. In still further examples, fuel vapor levels in the canister 22, and/or an amount of fuel vapors flowing from the canister 22 may be estimated based on outputs from only the pressure sensors 36. However, the controller 12 may estimate fuel vapor levels in the canister 22, and/or an amount of fuel vapors flowing from the canister 22 based on outputs from oxygen sensor 77 and the temperature sensor 32. In other examples, the controller 12 may estimate fuel vapor levels in the canister 22, and/or an amount of fuel vapors flowing from the canister 22 based on outputs from the oxygen sensor 77 and the pressure sensors 36. Further, in some examples, the controller 12 may estimate fuel vapor levels in the canister 22 and/or an amount of fuel vapors flowing from the canister 22 based on outputs from the pressure sensor 36 and the temperature sensor 32. In still further examples, the controller 12 may estimate fuel vapor levels in the canister 22 based on outputs from the oxygen sensor 77, pressure sensor 36, and temperature sensor 32.

Based on one or more of the estimated fuel vapor levels in the canister 22, vacuum level in the intake manifold, and a desired purge flow rate, the controller 12, may adjust the position of valves 61 and 29. Thus, in some examples valves 61 and 29 may be actively controlled valves, and may each be coupled to an actuator (e.g., electromechanical, pneumatic, hydraulic, etc.), where each actuator may receive signals from the controller 12 to adjust the position of its respective valve 61 and 29. However, in other examples, the valves may not be actively controlled, and instead may be passively controlled valves, where the position of the valves may change in response to changes in pressure, temperature, etc., such a wax thermostatic valve.

In examples where the valves 61 and 29 are actively controlled, the valves 61 and 29 may be binary valves, and the position of the valves 61 and 29 may be adjusted between a fully closed first position and a fully open second position. However in other examples, the valves 61 and 29 may be continuously variable valves, and may be adjusted to any position between the fully closed first position and fully open second position. Further, the actuators may be in electrical communication with the controller 12, so that electrical signals may be sent between the controller 12 and the actuators. Specifically, the controller may send signals to the actuators to adjust a position of the valves 61 and 29 based on fuel vapor levels in the canister 22. In some examples, the controller 12 may send signals to the actuators to open one or more of valves 61 and 29, and therefore purge the canister 22, in response to fuel vapor levels in the canister 22 exceeding a threshold. Valves 61 and 29 may be solenoid valves, and operation of the valves 61 and 29 may be regulated by adjusting a driving signal (or pulse width) of the dedicated solenoid. Thus, in response to outputs from one or more of the oxygen sensor 77, the temperature sensor 32, and the pressure sensor 36, the controller 12 may adjust the position of one or more of the valves 29 and 61. Additionally, the controller 12 may adjust the position of the valves 29 and 61 based on one or more of an estimated MAF in the intake manifold 44 and/or an amount of vacuum in the intake manifold 44.

In some examples, the canister 22 may be a heated fuel vapor canister 22, and may include a heater 24 positioned either exterior, within, or partially within the canister 22. The heater 24 may be configured to heat canister 22 to increase desorption and purging of fuel vapors from canister 22. Specifically, the heater 22 may be in electrical communication with the controller 12. The controller may send signals to the heater 24 to heat the canister 22, in response to the controller 12 determining that fuel vapor levels in the canister 22 are above a threshold. Thus, the heater 24 may be operated during purging of fuel vapors from the canister 22 to increase desorption of fuel vapors.

EVAP system 51 may further include a mixing valve 54 positioned in fresh air line 27, between the canister 22 and the vent valve 29. As shown in the examples of FIG. 1A, the mixing valve 54 may be a butterfly valve comprising a pivotable plate 56. However, in other examples, the mixing valve 54 may be another type of valve such as a gate valve, poppet valve, diaphragm valve, ball valve etc. In some examples, as shown below with reference to FIGS. 2A and 2B, the mixing valve 54 may only occupy a portion of the interior volume of the fresh air line 27. The mixing valve 54 may further be either passively or actively controlled. In examples, where the mixing valve 54 is actively controlled, the position of the valve 54 may be adjusted by an actuator 58 of the valve 54. Specifically, in examples where the valve 54 is a butterfly valve, the position of the plate 56 may be adjusted by the actuator 58 of the valve 54. Thus, the actuator may be physically coupled to the plate 56 via a mechanical linkage 57, which in some examples may be a rotatable rod. In this way, the actuator 58 may rotate the mechanical linkage 57, coupled to the plate 56, for adjusting and/or pivoting the plate 56. Actuator 58 may be an electromechanical actuator such as an electric motor, where actuator 58 may comprise a solenoid and/or armature and coil assembly. However, in other examples, the actuator 58 may be any viable actuator such as pneumatic, hydraulic, etc.

The actuator 58 may be in electrical communication with the controller 12, so that electrical signals may be transmitted there-between. In particular, the controller 12 may send signals to the actuator 58 to adjust the position of the valve 54, specifically of plate 56, based on one or more of signals received from one or more sensors, a vacuum level in the intake manifold 44, an intake mass air flow rate, and a position of the purge valve 61. For example, as described in FIG. 3 the controller 12 may send signals to the actuator 58 to adjust the position of the plate 56 to a more open position in response to one or more of increases in intake manifold vacuum, decreases in the intake mass air flow, closing of the throttle 62, and adjusting of the purge valve 61 towards a more open position.

In examples where actuator 58 is an electromechanical actuator, such as an electric motor or solenoid, opening or closing of mixing valve 54 may be performed via actuation of a solenoid in the actuator 58 by controller 12. Specifically, a pulse width modulated (PWM) signal may be communicated to the actuator 58 during a canister purging operation. In one example, the PWM signal may be at a frequency of 10 Hz. In another example, the actuator 58 may receive a PWM signal of 20 Hz. In yet another examples, the solenoid of the actuator 58 may be actuated synchronously.

In examples where the mixing valve 54 is a butterfly valve as depicted in the example of FIG. 1A, it should be appreciated that mixing valve 54 may increase the commingling of gasses in fresh air line 27 and canister 22. FIGS. 2A-2B show how the position of mixing valve 54 may be adjusted to increase turbulence of fresh air flowing through canister 22, and therefore increase the efficiency of canister purging.

It should be appreciated that fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open VBV 52 and canister vent valve 29 while closing canister purge valve (CPV) 61 to direct refueling vapors into canister 22 while preventing fuel vapors from being directed into the intake manifold.

Controller 12 may comprise a portion of a control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 37 located upstream of the emission control device, manifold air pressure sensor 64, MAF sensor 68 temperature sensor 33, pressure sensor 36, temperature sensor 32, and pressure sensor 91. Other sensors such as pressure, temperature, air/fuel ratio, and composition sensors may be coupled to various locations in the vehicle system 6. As another example, the actuators may include actuator 58 of mixing valve 54, fuel injector 66, throttle 62, vapor blocking valve 52, pump 92, and refueling lock 45. The control system 14 may include a controller 12. The controller may receive input data from the various sensors, process the input data, and trigger the actuators in response to the processed input data based on instruction or code programmed therein corresponding to one or more routines. An example control routine is described herein with regard to Leak detection routines may be intermittently performed by controller 12 on fuel system 18 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 95 communicatively coupled to controller 12. ELCM 95 may be coupled in vent 27, between canister 22 and the atmosphere. ELCM 95 may include a vacuum pump for applying negative pressure to the fuel system when administering a leak test. ELCM 95 may further include a reference orifice and a pressure sensor 96. Following the applying of vacuum to the fuel system, a change in pressure at the reference orifice (e.g., an absolute change or a rate of change) may be monitored and compared to a threshold. Based on the comparison, a fuel system leak may be diagnosed.

Canister purging may be intermittently performed by controller 12 in combination with various actuator in EVAP system 51. For example, as described in greater detail below with reference to FIG. 3, the controller 12 may determine if canister purging is desired based on one or more of fuel vapor levels in the canister 22, a desired air/fuel ratio, desired engine torque, position of throttle 62, intake MAF, vacuum in intake manifold 44, etc. The intake manifold 44 may only be capable of receiving up to a threshold amount of hydrocarbons from the canister 22 depending on the desired torque, air/fuel ratio, etc. In other words, the controller 12, may determine that purging of canister 22 is desired based both an amount of fuel vapors in the canister 22, and on an estimated amount of hydrocarbons that may enter the intake manifold 44 upon opening of purge valve 61.

Thus, the controller may estimate canister purge levels based on signals received from one or more of sensors 32, 36, and 77. Further, the controller may determine whether purging of canister 22 is desired based on one or more an intake manifold vacuum level which may be estimated based on outputs of sensor 64, an intake MAF which may be estimated based on outputs of sensor 68, and the estimated fuel vapor level in the canister 22. To initiate purging of the canister 22, controller 12 may send signals to one or more of valves 61 and 29, for adjusting the valves 61 and 29 to more open positions. Additionally, the controller 12 may send signals to the mixing valve 54 during purging of the canister 22, to adjust a position of the mixing valve 54 based on an estimated amount of fuel vapors being desorbed and purged from the canister 22. As described above, the amount of fuel vapors being desorbed and purged from the canister 22 may be estimated based on outputs from one or more of sensor 32, 36, and 77.

Turning now to FIG. 1B, it shows aspects of another example vehicle system 106. Vehicle system 106 is identical to vehicle system 6 except that vehicle system 106 may include a second mixing valve 154 in addition to first mixing valve 54 shown in FIG. 1. Second mixing valve 154 may be positioned downstream of purge valve 61, and upstream of intake manifold 44. As such components in the vehicle system 106 are the same as those previously introduced in vehicle system 6 shown in FIG. 1A. As such, components in vehicle system 106 previously introduced in FIG. 1A, may not be reintroduced, or discussed in the description of FIG. 1B.

As described above with reference to FIG. 1A, the mixing valve 54 may be positioned upstream of the canister 22 to increase commingling and/or turbulence in gasses entering and flowing through the canister 22. During purging of the canister 22, gasses flowing to the intake manifold 44 along purge line 28 may preferentially flow to one or a portion of the cylinders 30 in engine 10. Said another way, gasses flowing from canister 22 during purging towards the engine cylinders 30, may not evenly flow to all of the cylinders 30. To increase uniformity of flow to the engine cylinders 30, in some examples, as shown the example vehicle system 106 of FIG. 1B, the second mixing valve 154 may be included in the flow path between the purge valve 61 and the intake manifold 44.

Adjusting and/or operation of the second mixing valve 154 may be similar to that of first mixing valve 54 described above with reference to FIG. 1A. Thus, the mixing valve 154, may be a butterfly valve comprising a pivotable plate 156. However, in other examples, the mixing valve 154 may be another type of valve such as a gate valve, poppet valve, diaphragm valve, ball valve etc. The mixing valve 154 may further be either passively or actively controlled.

In examples where the mixing valve 154 is a butterfly valve as depicted in the example of FIG. 1B, it should be appreciated that mixing valve 154 may increase the commingling of gasses in intake manifold 44. FIGS. 2A-2B show how the position of a mixing valve such as mixing valve 154 may be adjusted to increase turbulence of fresh air flowing through the valve. In this way, by including the mixing valve 154 in a flow path between the canister 22 and the intake manifold 44, and/or adjusting the position of the mixing valve 154, the uniformity of gas dispersion to each of the engine cylinders 30 may be increased during purging of canister 22 to the intake manifold 44.

As such, the second mixing valve 154 may be either a passively controlled valve or an actively controlled valve. In examples, where the mixing valve 154 is actively controlled, the position of the valve 154 may be adjusted by an actuator 158 of the valve 154. Specifically, in examples where the valve 154 is a butterfly valve, the position of the plate 156 may be adjusted by the actuator 158 of the valve 154. Thus, the actuator may be physically coupled to the plate 156 via a mechanical linkage 157, which in some examples may be a rotatable rod. In this way, the actuator 158 may rotate the mechanical linkage 157, coupled to the plate 156, for adjusting and/or pivoting the plate 156. Actuator 158 may be any viable actuator such as electromechanical, pneumatic, hydraulic, etc.

The actuator 158 may be in electrical communication with the controller 12, so that electrical signals may be transmitted there-between. Specifically, the controller 12 may send signals to the actuator 158 to adjust the position of the valve 154, specifically of plate 156, based on one or more of signals received from one or more sensors, a vacuum level in the intake manifold 44, an intake air flow rate, and a position of the purge valve 61. For example, as described in FIG. 3 the controller 12 may send signals to the actuator 158 to adjust the position of the plate 156 to a more open position in response to one or more of increases in intake manifold vacuum, increase in the intake mass air flow, and adjusting of the purge valve 61 towards a more open position.

More specifically, in examples where the actuator 158 is an electromechanical actuator, such as a solenoid or electric motor, opening or closing of mixing valve 154 may be performed via actuation of a solenoid in the actuator 158 by controller 12. Specifically, a pulse width modulated (PWM) signal may be communicated to the solenoid of the actuator 158 during a canister purging operation. In one example, the PWM signal may be at a frequency of 10 Hz. In another example, the actuator 158 may receive a PWM signal of 20 Hz. In yet another examples, the solenoid of the actuator 158 may be actuated synchronously.

Moving on to FIGS. 2A and 2B, they show examples of airflow through an EVAP system 200 during purging of a fuel vapor canister. EVAP system 200 may be the same as EVAP system 51 described above with reference to FIGS. 1A-1B, and as such components of EVAP system 200 may be the same as components of EVAP system 51. For example, mixing valve 254 shown in FIGS. 2A-2B may be the same as mixing valve 54 shown in FIGS. 1A-1B. Similarly, canister 222 shown in FIGS. 2A-2B may be the same as canister 22 shown in FIGS. 1A-1B. Further, EVAP system 200 may be included in a vehicle system such as vehicle system 6 and vehicle system 106 shown above with reference to FIGS. 1A-1B.

FIGS. 2A and 2B, show examples of how the position of a mixing valve positioned in a gas flow path may be adjusted to increase turbulence and commingling of gasses downstream of the mixing valve. As such, FIGS. 2A and 2B may be discussed together in the description herein. FIG. 2A, shows an embodiment of an EVAP system 200 in which the mixing valve 254 is adjusted to a closed first position, such that airflow through a first conduit 202 of fresh air line 227 may be restricted. An open second position of the valve 254 is shown in FIG. 2B, where gasses may flow past the valve 254 through first conduit 202.

Fresh air line 227 may be the same as fresh air line 27 shown in FIGS. 1A-1B. As such, fresh air line 227 may be open at one end to fresh air from outside the fresh air line 27, and at the other end may be coupled to the canister 222. As such, fresh air may flow through fresh air line 27 to canister 222. Fresh air line 227 may be divided into a first conduit 202 and second conduit 204 that are separated by a wall 210. Thus, where wall 210 is included in fresh air line 227, first and second conduits 202 and 204, respectively, may be fluidically sealed from one another. Said another way, fluids may not flow through wall 210 between first conduit 202 and second conduit 204. Wall 210 is not included in canister 222. Thus, as shown by the flow arrows 206 in FIGS. 2A and 2B, flow through the conduits 202 and 204, may converge before or at the canister 222.

Thus, the wall 210 may define the two conduits 202 and 204, where the conduits 202 and 204 may be approximately parallel to one another within fresh air line 227. Air entering fresh air line 227 may flow into fresh air line 227, and may then flow into either conduit 202 or 204, where wall 210 begins in fresh air line 227. In some examples, wall 210 may extend along the full length of the fresh air line 227. However, in other examples, wall 210 may only extend along a portion of the length of fresh air line 227.

During purging of the canister 222, where air flows through canister 222, fuel vapors stored in canister 222 may be desorbed. Specifically, fuel vapors may be desorbed as they come into contact with air flowing through the canister. As such, gasses from fresh air line 227 and/or fuel vapors from canister 222 may exit canister 222, and flow towards an intake manifold (e.g., intake manifold 44 shown in FIGS. 1A and 1B) via purge line 228. The purging efficiency of the canister 222 may be representative of an amount of fuel vapors desorbed from the canister 222. Thus, the purging efficiency of the canister 222 may increase with increasing amounts of fuel vapors purged from the canister 222.

However, in some examples, airflow through the canister 222 may be restricted to only a portion of the canister 222. In such examples, fuel vapors not in the flow path of the airflow through the canister 222 may not be desorbed during canister purging. Therefore, an amount of fuel vapors purged from the canister 222 may increase with increases in a volume of the canister 222 through which air flows during purging of the canister 222. Increases in a mass airflow rate through the canister 222, and/or an amount of turbulence in the airflow through the canister 222 may increase the volume of the canister 222 through which gasses flow. Specifically, increases in the amount of turbulence in the airflow entering the canister 222, may increase dispersion of airflow through the canister 222. Thus, turbulence in the airflow entering the canister 222 may be increased to increase canister purging efficiency. In some examples, turbulence in the airflow entering the canister 222 may be increased in response to decreases in canister purging efficiency. For example, canister purging efficiency may decrease due to decreases in the mass airflow rate through the canister from closing of a purge valve (e.g., purge valve 61 shown in FIGS. 1A and 1B), and/or decreases in manifold vacuum level, etc.

To increase turbulence in the airflow entering the canister 222, a mixing valve 254 may be positioned in one of the conduits in fresh air line 227. The position of the mixing valve 254 may be adjusted to increase turbulence in the airflow entering the canister 222. Increasing turbulence in the airflow entering the canister, may increase the uniformity of flow of gasses within the full volume of the canister 222. Further, increasing the turbulence may increase the dispersion and/or commingling of gasses within the canister 222. In this way, adjusting the mixing valve 254 may increase the uniformity of flow of gasses within the volume of the canister 222, the dispersion and/or commingling of gasses within the canister 222, and therefore a purging efficiency and/or desorption of fuel vapors in the canister 222. In the example shown in FIGS. 2A and 2B, mixing valve 254 may be positioned in the first conduit 202. As such, mixing valve 254 may regulate airflow through the conduit 202. Specifically, the position of mixing valve 254 may be adjusted to between a closed first position where no air flows in the conduit 202, and an open second position where air flow through the conduit 202.

As described above with reference to FIG. 1, mixing valve 254 may be a butterfly valve, where the position of a pivotable plate 256 of the valve 254 may be adjusted by an actuator 258 of the valve 254. Specifically, a rotatable rod 257 may physically couple the actuator 258 to the plate 256, for adjusting of the plate 256. The actuator 258 may rotate the rod 257, which in turn pivots and/or rotates the plate 256, to adjust airflow through the conduit 202. The rod 257 may be physically coupled on a first end to the plate 256 and on an opposite second end to the actuator 258. Operation and/or adjusting of the mixing plate 256 by the actuator 258 may be performed in the manner described above of the mixing valve 54 shown in FIGS. 1A and 1B. For example actuator 258 may be in electrical communication with a controller (e.g., controller 12 shown in FIGS. 1A and 1B). Based on signals received from the controller, the actuator 258 may rotate the rod 257 and adjust the position of the plate 256. As described above with reference to FIGS. 1A and 1B, the actuator 258 may be any viable actuator such as an electromechanical actuator comprising a coil and armature assembly. In other examples, the actuator 258 may be pneumatic, hydraulic, etc.

By rotating rod 257, the actuator 258 may adjust the position of the plate 256, so that an edge 208 of plate 256 is rotated and/or pivoted within conduit 202. For example, in FIG. 2A, plate 256 is shown in approximately the closed first position, and is rotated in FIG. 2B, to approximately the open second position. An opening may be formed between the edge 208 of the plate 256, and walls of conduit 202, where the opening may increase with increasing deflection of the plate 256 away from the closed first position towards the open second position. Therefore an amount of air flowing through the conduit 202 may increase with increasing deflection of the plate 256 away from the closed first position towards the open second position. Thus, a ratio of airflow through conduit 202 relative conduit 204 may be adjusted by adjusting the position of valve 254, specifically of plate 256. Said another way, an amount of gasses flowing through conduit 202 relative to conduit 204 in fresh air line 227 may be adjusted by adjusting the position of valve 254. Specifically a ratio of airflow through conduit 204 relative to conduit 202 may increase with increasing deflection of the plate 256 towards the closed first position away from the open second position.

By adjusting the amount of gasses flowing through the conduit 202 to the canister 222, an amount of turbulence in the gas flow may be regulated. For example, decreasing the amount of air flowing through conduit 202 relative to conduit 204 may increase turbulence in the gas flow in canister 222. Increasing the amount of turbulence in the gas flow may cause an increase in an amount mixing and/or dispersion of gasses within the canister 222. As such, gasses may flow through a greater volume of the canister 222, resulting in increased desorption of fuel vapors, and therefore purging efficiency. In this way, an amount of turbulence in the gasses flowing downstream of the valve 254 may be adjusted by adjusting the position of the valve 254. For example, as shown in FIG. 2B, when the valve 254 is in the open second position, an amount of air flowing through conduits 202 and 204 may be approximately the same. As such, gasses flowing in fresh air line 227 may flow relatively unimpeded to the canister 222.

However, in the example shown in FIG. 2A, where the mixing valve 254 may be in the closed first position, turbulence in the flow of gasses downstream of the mixing valve 254 may be increased relative to upstream of the mixing valve 254. Specifically, as shown in FIG. 2A, gasses may flow through the canister 222 in a spiral pattern. Thus, as shown in FIGS. 2A and 2B, a swirl pattern of the gasses flowing through the canister 222 may be adjusted by adjusting the position of the mixing valve 254. Specifically, adjusting plate 256 of valve 254 towards the closed first position may increase an amount of swirling in the gasses flowing through the canister 222. As such, dispersion of gasses flowing through canister 222 may be increased when the mixing valve 254 is adjusted to the closed first position relative to the second open position. Said another way, turbulence in the flow of gasses downstream of the mixing valve 254 may be increased when the valve is in the closed first position relative to when the valve 254 is in the open second position as shown in FIGS. 2A and 2B. In this way, an amount of turbulence generated in the gasses flowing in the fresh air line 227 and into the canister 222 may be adjusted by adjusting the position of the plate 256 of mixing valve 254. Specifically, an amount of turbulence and/or commingling of gasses generated in the gasses flowing in the fresh air line 227, may be increased with increasing deflection of the plate 256 towards the closed first position away from the open second position. Thus, gasses flowing through canister 222, may flow through a greater volume of canister 222 when the mixing valve 254 is in the closed first position than when the mixing valve 254 is in the open second position.

Further, continual adjusting of the plate 256 may increase turbulence generated in the gasses flowing in fresh air line 227 to canister 222. Thus, by rotating the rod 257, and pivoting and/or rotating the plate 256 back and forth between two or more positions between the closed first position and closed second position, airflow patterns through fresh air line 227 may be manipulated and/or disrupted, so that turbulence in the airflow through fresh air line 227 may be increased. In this way, gasses may disperse into a greater volume of the canister 222, which may result in increased desorption of fuel vapors and therefore purging efficiency. The purging efficiency of the canister 222 may therefore be increased by adjusting of the valve 254.

However, purging efficiency of the canister 222 may also be based on a mass airflow rate through the canister 222. Specifically, purging efficiency of the canister 222 may increase with increasing mass airflow rates through the canister. Thus, purging efficiency of the canister 222 may be determined by both the mass airflow rate of gasses flowing through the canister 222 during purging operation, and on a position of the mixing valve 254 in fresh air line 227. As described in the method of FIG. 3, the mixing valve 254 may be adjusted to the open first position when the mass airflow through the canister 222 is greater than a threshold. Mass airflow rates through the canister 222 may be based on an amount of vacuum generated by the intake manifold. Since the vacuum in the intake manifold may be based on a position of a throttle (e.g., throttle 62 shown in FIGS. 1A and 1B), the mass airflow rate through the canister 222 may be dictated by a position of the throttle. Specifically, the mass airflow rate through the canister 222 may increase with one or more of increasing manifold vacuum levels and/or increasing deflection of the throttle away from a closed first position towards an open second position. Thus, when the mass airflow rates through the canister 222 decrease, the mixing valve 254 may be adjusted to a more closed position to increase turbulence, and therefore fuel vapor desorption in the canister 222. Put more simply, the position of the mixing valve 254 may be adjusted to increase the purging efficiency of the canister 222.

In some examples, as described above in FIGS. 1A and 1B, outputs from an oxygen sensor positioned downstream of the canister 222 may be used to determine a purging efficiency of the canister 222. The position of the plate 256 may be adjusted based on the estimated purging efficiency.

Although the mixing valve 254 is shown positioned upstream of the canister 222, it should be appreciated that in alternate embodiments, the mixing valve 254 may be position downstream of the canister 222 in the purge line 228 as shown above with reference to valve 154 in FIG. 1B. In examples where the mixing valve 254 is positioned in the purge line 228 upstream of the intake manifold, the mixing valve 254 may be adjusted in a similar manner as described above to increase dispersion and/or commingling of gasses entering the intake manifold and flowing to engine cylinders (e.g., engine cylinders 30 shown in FIGS. 1A and 1B). In this way, gasses may flow more evenly to each of the engine cylinders, by adjusting a mixing valve positioned downstream of the canister 222.

Referring now to FIG. 3, is shows a method 300 for regulating flow through a fuel vapor canister (e.g., canister 22 shown in FIGS. 1A and 1B). Specifically, method 300 is an example method for adjusting a mixing valve (e.g., mixing valve 54 shown in FIGS. 1A and 1B) positioned upstream of the canister, for increasing fuel vapor desorption from the canister during a purging operation of the canister, where fuel vapors from the canister are routed to an intake manifold (e.g., intake manifold 44 shown in FIGS. 1A and 1B). Mass airflow through the canister during purging operation may be determined by a position of a canister purge valve (e.g., purge valve 61 shown in FIGS. 1A and 1B) and/or an amount of vacuum in the intake manifold. Airflow through the canister may not be uniform. Due to uneven airflow through the canister, and/or incomplete dispersion of gasses within the canister during purging operation, desorption of fuel vapors in the canister may not be uniform. Specifically, areas of the canister with greater airflow rates may desorb more fuel vapors than areas of the canister with lower airflow rates. As such, purging of the canister may not be even. Certain areas of the canister may be purged of fuel vapors more quickly than others.

To increase dispersion of gasses within the canister, and therefore encourage more even fuel vapor desorption, turbulence in the airflow entering the canister may be increased by adjusting the position of the mixing valve. As such, an actuator (e.g., actuator 58 shown in FIG. 1A) mechanically coupled to the mixing valve, may adjust the position of the mixing valve based on signals received from a controller (e.g., controller 12 shown in FIGS. 1A and 1B). Therefore a method, such as method 300 may be executed by the controller. As such, the method 300 may be stored in non-transitory memory on the controller, and may be executed based on signals received from various engine sensors (e.g., sensors 77, 36, and 32 shown in FIGS. 1A and 1B).

Method 300 begins at 302 by estimating and/or measuring engine operating conditions. Engine operating conditions may include an intake manifold vacuum level, which may be estimated based on outputs from a manifold pressure sensor (e.g., manifold air pressure sensor 64 shown in FIGS. 1A and 1B), and an intake mass airflow which may be estimated based on one or more of outputs from an intake mass airflow sensor (e.g., MAF sensor 68 shown in FIGS. 1A and 1B), and a position of a throttle (e.g., throttle 62 shown in FIGS. 1A and 1B). Further, engine operating conditions may include a fuel vapor level in the canister which may be based on outputs from one or more of an oxygen sensor (e.g., oxygen sensor 77 shown in FIGS. 1A and 1B) positioned downstream of the canister, a pressure sensor (e.g., pressure sensor 36 shown in FIGS. 1A and 1B) coupled to the canister, and a temperature sensor (e.g., temperature sensor 32 shown in FIGS. 1A and 1B) coupled to the canister.

After estimating and/or measuring engine operating conditions at 302, method 300 may then proceed to 304 which comprises determining if purging of the canister is desired. Determining if canister purging is desired may include one or more of determining if the fuel vapor level in the canister is greater than a threshold, and if opening the purge valve would result in a decrease in engine performance and/or a decrease in the functionality of other engine components, such as regeneration of a brake booster and/or ventilation of a crankcase, etc. Thus, if fuel vapor levels in the canister are not greater than the threshold, and/or opening of the purge valve would cause a corresponding decrease in intake manifold vacuum that may decrease one or more of engine performance, brake booster regeneration, positive crankcase ventilation, etc., then it may be determined at 304 that purging of the canister is not desired, and method 300 may continue to 306 which comprises closing the purge valve and/or maintaining the position of the mixing valve.

Thus, the method 300 at 306 may comprise adjusting the position of the purge valve towards a more closed position. As described above with reference to FIGS. 1A-2B, the purge valve may be adjusted between a closed first position and an open second position based on signals received from the controller, where an opening formed between the valve and a purge line (e.g., purge line 28 shown in FIGS. 1A and 1B) in which the valve is positioned may increase with increasing deflection away from the closed first position towards the open second position. In some examples, the method 300 at 306 may comprise adjusting the position of the purge valve to the fully closed first position. Additionally, the method at 306 may comprise maintaining a position of the mixing valve. However, in other examples, the method at 306 may comprise adjusting the mixing valve to a closed first position. In still further examples, the method at 306 may comprise adjusting the mixing valve at an open second position. Adjusting of the mixing valve may be performed in the manner described above with reference to FIGS. 1A and 1B. Thus, a plate (e.g., plate 56 shown in FIGS. 1A and 1B) of the mixing valve may be adjusted by an actuator (e.g., actuator 158 shown in FIGS. 1A and 1B) based on signals received from the controller. As such, the method at 306 may comprise sending signals to the actuator of the mixing valve from the controller to maintain the position of the mixing valve. Method 300 then ends.

Returning to 304 of method 300, if it is determined that canister purging is desired, method 300 may then continue to 308 and determine a desired purge flow rate based on one or more of a desired air/fuel ratio, desired engine torque, throttle position, intake manifold vacuum, fuel vapor level in the canister, etc. More specifically, the desired purge flow rate may increase with increasing fuel vapor levels in the canister. Further, the desired purge flow rate may increase with increasing manifold vacuum level, as the intake manifold may be capable of accepting more airflow from the purge line with increasing manifold vacuum level.

After determining the desired purge flow rate at 308, method 300 may subsequently adjust the position of the canister purge valve based on the desired purge flow rate at 310. Thus, a table of values containing desired purge flow rates and their corresponding canister purge valve positions may be stored in non-transitory memory of the controller. The controller may determine the position to which the canister purge valve may be adjusted in order to achieve the desired canister purge flow rate based on the table of values. Further, the controller may send signals to the canister purge valve for adjusting the position of the valve to an open position to enable purging of the canister. Thus, the method 300 at 310 may include increasing the opening of the canister purge valve by adjusting the valve to a more open position.

After opening the purge valve and enabling canister purging at 310, the method 300 may then continue to 312 which comprises adjusting the position of the mixing valve based on the purge flow rate. As described above, the mixing valve may be positioned upstream of the canister in a fresh air line (e.g., fresh air line 27 shown in FIGS. 1A and 1B). Further, the mixing valve may be positioned in a conduit (e.g., conduit 202 shown in FIGS. 2A and 2B) of the fresh air line, so that even in the closed first position, gasses may still flow through the fresh air line to the canister during purging of the canister. However, gasses may not flow through the conduit in which the mixing valve is positioned.

Specifically, the mixing valve may be adjusted to a more closed position where an opening formed between an edge (e.g., edge 208 shown in FIGS. 2A and 2B) of the plate and walls of the conduit in which the mixing valve is positioned is increased in response to one or more of decreases in the purge flow rate through the canister, decreases in the intake manifold vacuum level, opening of the throttle, etc. Thus, as described above in FIGS. 2A and 2B, the mixing valve may be adjusted towards a more closed position to increase turbulence in the air entering the canister, to increase canister purging efficiency. By adjusting the mixing valve to a more closed position, turbulence in the airflow entering the canister may be increased. Conversely, the mixing valve may be adjusted towards a more open position in response to one or more of increases in the mass airflow rate through the canister, increases in the intake manifold vacuum, and closing of the throttle. However, in still further examples, the position of the mixing valve may be oscillated between two or more positions between the closed first position and the open second position. Said another way, the valve may be continuously adjusted back and forth between two or more positions to cause fluctuations in the amount of air flowing past the mixing valve, and therefore increase turbulence in the air entering the canister.

Method 300 may then continue to 314 and determine the purging efficiency of the canister based on outputs from one or more of the oxygen sensor, pressure sensor, and temperature sensor. As described above with reference to FIGS. 1A and 1B, one or more or each of the oxygen sensor, pressure sensor and temperature sensor may be used to estimate an amount of fuel vapors being purged from the canister. For example, outputs from the oxygen sensor during purging operation may be compared to outputs when the purge valve is closed. Specifically, differences between the outputs from the oxygen sensor during purging operation and non-purging operation may be used to estimate an amount of fuel vapors in the gasses flowing past the oxygen sensor and therefore being desorbed from the canister. Further, changes in the oxygen concentration estimated from the outputs of the oxygen sensor may be used to infer changes in the fuel desorption rate from the canister. Specifically, as the amount of fuel desorption from the canister increases, a concentration of fuel vapors in gasses flowing past the oxygen sensor may increase, resulting in a corresponding decrease in the oxygen concentration of said gasses. Thus, decreases in the oxygen concentration of gasses being sampled by the oxygen sensor may represent corresponding increases in the amount of fuel vapors being desorbed from the canister. In this way, decreases in the oxygen concentration as estimated based on outputs from the oxygen sensor may indicate increases in canister purging efficiency, and conversely, increases in the oxygen concentration may indicate decreases in canister purging efficiency.

Changes in the temperature in the canister as estimated from outputs of the temperature sensor, and changes in the pressure in the canister as estimated from the pressure sensor may be used to estimate an amount of fuel vapors exiting the canister. Temperatures and/or pressures in the canister may decreases with increases in the amount of fuel vapors being purged from the canister.

Method 300 may then proceed from 314 to 316, which comprises adjusting the mixing valve based on the estimated purging efficiency. Thus, the method 300 at 316 may comprise adjusting the position of the mixing valve based on signals received from the oxygen sensor. If the purging efficiency of the canister decreases (e.g., oxygen concentration increases), then the mixing valve may be adjusted to a more closed position. Conversely, if the purging efficiency of the canister increases (e.g., oxygen concentration decreases) the position of the mixing valve may be maintained. Further, the mixing valve may continue to be adjusted to different positions until the purging efficiency of the canister increases.

Adjusting of the mixing valve may comprise pivoting and/or rotating of the plate of the mixing valve. Specifically, the plate may be pivoted by rotating of a rod coupled on a first end to the plate, and on an opposite second end to the actuator. Thus, the actuator may rotate the rod to adjust the position of the plate and therefore the valve. Closing of the valve 254, may comprise rotating the rod and therefore pivoting the plate so that an opening formed between an edge (e.g., edge 208 shown in FIGS. 2A and 2B) of the plate and a fresh air line (e.g., fresh air line 227 shown in FIGS. 2A and 2B) may be decreased and an amount of turbulence in air entering the canister may be increased. Conversely, opening of the valve 254, may comprise rotating the rod and therefore pivoting the plate so that an opening formed between an edge (e.g., edge 208 shown in FIGS. 2A and 2B) of the plate and a fresh air line (e.g., fresh air line 227 shown in FIGS. 2A and 2B) may be increased and an amount of turbulence in air entering the canister may be decreased.

In some examples, the position of the mixing valve may be indexed to a plurality of positions depending on the resulting purging efficiency at each position. In some examples, the mixing valve may be monotonically deflected towards the closed first position until the purging efficiency increases. However, in other examples, the mixing valve may be oscillated back and forth between more open and more closed positions. In some examples, the oscillating the valve may increase turbulence in the airflow entering the canister. Thus, in some examples, a frequency of oscillation, and/or an amplitude of oscillation may be gradually adjusted until the purging efficiency increases.

Thus, the amount that the plate is pivoted/rotated, and/or the frequency at which it is pivoted/rotated may be monotonically increased or decreased until the purging efficiency increases. In examples, where the position of the valve is oscillated, the amount that the plate is pivoted/rotated during each oscillation may be monotonically increased, and the frequency at which the plate is pivoted/rotated may be increased so that the time between oscillations may be decreased until the purging efficiency increases. However, in other examples where the position of the valve is oscillated, the amount that the plate is pivoted/rotated during each oscillation may be monotonically increased, and the frequency at which the plate is pivoted/rotated may be decreased so that the time between oscillations may be increased until the purging efficiency increases. In still further examples where the position of the valve is oscillated, the amount that the plate is pivoted/rotated during each oscillation may be monotonically decreased, and the frequency at which the plate is pivoted/rotated may be increased so that the time between oscillations may be decreased until the purging efficiency increases. In other examples where the position of the valve is oscillated, the amount that the plate is pivoted/rotated during each oscillation may be monotonically decreased, and the frequency at which the plate is pivoted/rotated may be decreased so that the time between oscillations may be increased until the purging efficiency increases.

In this way, the position of the mixing valve, and specifically of the plate of the mixing valve may be adjusted based on purging efficiency of the canister, which may be determined based on outputs from the oxygen sensor. Thus, based on outputs from the oxygen sensor, an amount of fuel vapors being purged from the canister may be estimated. The mixing valve may be indexed to a plurality of positions, and the resulting fuel vapor desorption amount may be estimated based on outputs from the oxygen sensor. Said another way, the purging efficiency that may result from the mixing valve being adjusted to any number of positions may be estimated based on outputs from the oxygen sensor. In this way, the purging efficiency of the canister may be increased. By adjusting the position of the mixing valve, an amount of turbulence in the airflow entering the canister may be increased. As such, the uniformity of airflow through the canister may be increased, and therefore airflow through the canister may come into contact with a greater amount of fuel vapors. In this way, fuel vapor desorption and canister purging efficiency may be increased.

Method 300 may then continue from 316 to 318 and determine if fuel vapor levels in the canister are below a threshold. As described above, the fuel vapor levels in the canister may be estimated based on outputs from one or more of the oxygen sensor, pressure sensor, and temperature sensor. The threshold at 318 may represent fuel vapor levels in the canister, below which the fuel vapor canister may be clean, and substantially fully purged of fuel vapors. If the fuel vapor level in the canister is less than the threshold, method 300 may continue to 306 and close the purge valve and cease canister purging operation. Method 300 then ends.

However, if it is determined at 318 that fuel vapor levels in the canister are above the threshold, then method 300 may return to 312, and continue to purge the canister. Thus, so long as canister purging is desired, the purge valve may be maintained in an open position until the canister is fully purged of fuel vapors.

Turning now to FIG. 4, is shows a map 400 illustrating example purging operation in an example engine system, such as that of FIGS. 1A and 1B. Map 400 includes an indication of a desired engine torque at plot 402, position of a throttle (e.g., throttle 62 shown in FIGS. 1A and 1B) at plot 404, vacuum levels in an intake manifold (e.g., intake manifold 44 shown in FIGS. 1A and 1B) at plot 406, canister loading at plot 412. The throttle may be adjusted between a fully closed first position and a fully open second position based on the desired engine torque. Specifically in response to the desired torque increasing above a threshold 403, the throttle may be adjusted away from the closed first position towards the open second position.

Canister loading levels may represent an amount of fuel vapors stored in a fuel vapor canister (e.g., canister 22 shown in FIGS. 1A and 1B). Thus canister loading increases within increasing amounts of fuel vapors stored in the canister. In response to canister loading levels increasing above a threshold 413, a purge valve (e.g., purge valve 61 shown in FIGS. 1A and 1B) may be opened. Changes in the position of the purge valve is shown at plot 408. An estimated purge flow rate through the canister and purge valve are shown at plot 410. In response to changes in one or more of the manifold vacuum, purge flow rate, canister loading, and throttle position, a position of a mixing valve (e.g., mixing valve 54 shown in FIGS. 1A and 1B) may be adjusted as shown at plot 414. Thus, changes in the position of the mixing valve are shown at plot 414.

The desired engine torque may be estimated based on input from a vehicle operator (e.g., 132 shown in FIGS. 1A and 1B) via an input device (e.g., 130 shown in FIGS. 1A and 1B) which may include an accelerator pedal and/or brake pedal. Vacuum level in the intake manifold may be estimated based on outputs from a pressure sensor (e.g., 64 shown in FIGS. 1A and 1B) positioned in the intake manifold. As described above with reference to FIGS. 1A and 1B, and FIG. 3, canister loading may be estimated based on outputs from one or more of an oxygen sensor (e.g., oxygen sensor 77 shown in FIGS. 1A and 1B) positioned downstream of the canister, a pressure sensor (e.g. sensor 36 shown in FIGS. 1A and 1B), and a temperature sensor (e.g., temperature sensor 32 shown in FIGS. 1A and 1B). The purge flow rate may be estimated based on the vacuum level in the intake manifold and a position of the purge valve. Specifically, the purge flow rate may increase with increases in the purge valve and/or intake manifold vacuum levels.

As described above with reference to FIGS. 1A and 1B, the purge valve may be adjusted between a fully closed first position and a fully open second position where an opening formed by the valve and therefore an airflow through the valve may increase with increasing deflection towards the open second position away from the closed first position. Similarly, the mixing valve may be adjusted between a fully closed first position and a fully open second position where an opening formed by the valve and therefore an airflow through the valve may increase with increasing deflection towards the open second position away from the closed first position. The position of the mixing valve may be adjusted by an actuator (e.g., actuator 58 shown in FIGS. 1A and 1B) physically coupled to the mixing valve via a mechanical linkage (e.g., mechanical linkage 57 shown in FIGS. 1A and 1B). Thus the actuator may adjust the position of the mixing valve by rotating the mechanical linkage. Specifically, a controller (e.g., controller 12 shown in FIGS. 1A and 1B) may send signals to the actuator for adjusting a position of the mixing valve based on the estimated purge flow rate, manifold vacuum level, throttle position, etc.

Starting at t0, the desired engine torque is less than the threshold 403 (plot 402), and as such the throttle may be adjusted to the closed first position (plot 404). Manifold vacuum may remain at an upper first level (plot 406), and canister loading may remain below the threshold 413 (plot 412). Since the amount of fuel vapors stored in the canister is below the threshold 413, the purge valve may be closed (plot 408), and therefore the purge flow rate through the canister may remain at a lower first level P0. Mixing valve may remain in the closed first position at t0.

Between t0 and t1, the desired engine torque may monotonically increase, but remain below the threshold 403. As such, the throttle may remain closed before t1, and the manifold vacuum may fluctuate around the upper first level. Thus, engine operating conditions before t1 may represent engine idling. Canister loading may remain below the threshold 413, and therefore the purge valve may remain closed before t1. As such, the purge flow rate may remain at the lower first level P0, and the mixing valve may remain closed.

At t1, the desired engine torque may increase above the threshold 403. In response to the desired engine torque increasing above the threshold 403, the throttle may be adjusted towards the open second position. Due to the opening of the throttle at t1, the manifold vacuum may begin to decrease from the upper first level at t1. Canister loading may continue to increase at t1, but remain below the threshold 413. As such, the purge valve may remain closed at t1, and the purge flow rate may remain at the lower first level P0. The mixing valve may remain in the closed first position.

Between t1 and t2, the desired engine torque may monotonically increase above the threshold 403. As such, the throttle may be adjusted with increasing deflection towards the open second position away from the closed first position between t1 and t2, and as a result, the manifold vacuum may continue to decrease from upper first level to a lower second level. Canister loading may monotonically increase before t2, but may remain below the threshold 413, and therefore the purge valve may remain closed between t1 and t2. As such, the purge flow rate may remain at the lower first level P0, and the mixing valve may remain closed between t1 and t2.

At t2, the canister loading may increase above the threshold 413. In response to the canister loading increasing above the threshold 413, the purge valve may be opened at t2. Due to the opening of the purge valve, the purge flow rate may increase above the lower first level P0. The mixing valve may be partially opened at t2 to a partially open third position. Further, at t2, the desired engine torque may continue to increase above the threshold 403, and as such, the throttle may be fully opened at t2. The manifold vacuum may therefore remain at a lower second level.

Between t2 and t3, the desired engine torque may fluctuate above the threshold 403. As such, the throttle may remain fully open between t2 and t3, and as a result, the manifold vacuum may fluctuate around the lower second level. Although the purge valve may remain open between t2 and t3, the purge flow rate through the canister may increase only slight to an intermediate second level P1, due to the low manifold vacuum levels between t2 and t3. As such, canister loading may monotonically increase between t2 and t3. In response to the purge flow rate remaining at the intermediate second level P1, the mixing valve may remain in approximately the partially open third position.

At t3, the desired torque may begin to decrease, but may remain above the threshold 403. In response to the decrease in desired engine torque, the throttle valve may be adjusted away from the open second position towards the closed first position. Due to the closing of the throttle valve, the manifold vacuum may begin to increase from the lower second level at t3. In response to the canister loading remaining above the threshold at t3, the purge valve may remain open. However, due to the increase in manifold vacuum at t3, the purge flow rate may increase above the intermediate second level P1, at t3. Due to the increased purge flow rate, the canister loading may begin to decrease at t3. The mixing valve may be adjusted towards the fully open second position in response to the increased purge flow rate.

Between t3 and t4, the desired torque may continue to decrease to the threshold 403. In response to the decrease in desired engine torque, the throttle valve may be adjusted with increasing deflection away from the open second position towards the closed first position between t3 and t4. Due to the closing of the throttle valve, the manifold vacuum may continue to increase from the lower second level to the upper first level between t3 and t4. In response to the canister loading remaining above the threshold at t3, the purge valve may remain open. However, due to the increase in manifold vacuum at t3, the purge flow rate may increase above the intermediate second level P1, at t3. Due to the increased purge flow rate, the canister loading may begin to decrease at t3. The mixing valve may be adjusted towards the fully open second position in response to the increased purge flow rate.

At t4, the desired torque may reach the threshold 403, and in response to the desired torque reaching the threshold 403, the throttle may be fully closed. As such, the manifold vacuum may reach approximately the upper first level. Canister load may continue to decrease at t4, but may remain above the threshold 413. As such, the purge valve may remain open. Due to the manifold vacuum increasing to the upper first level, and the purge valve remaining fully open at t4, the purge flow rate may increase to an upper third level P2, where P2 may be greater than P1 and P0. In response to the purge flow rate reaching the upper third level P2, the mixing valve may be adjusted to the fully open second position at t4.

Between t4 and t5, the desired torque may continue to decrease below the threshold 403. In response to the decrease in desired engine torque, the throttle valve may remain in the closed first position. Due to the closure of the throttle valve, the manifold vacuum may continue to fluctuate around the upper first level between t4 and t5. Canister loading may continue to decrease between t4 and t5, but may remain above the threshold 413. In response to the canister loading remaining above the threshold 413, the purge valve may remain open. The purge valve may remain fully open at t4, and thus, the purge flow rate may continue to fluctuate around the upper third level P2. In response to the decrease in canister loading and continued fluctuation of the purge flow rate around the upper third level P2, the position of the mixing valve may be maintained in the fully open second position.

At t5, the desired torque may continue to decrease below the threshold 403. In response to the decrease in desired engine torque, the throttle valve may remain in the closed first position. Due to the closure of the throttle valve, the manifold vacuum may continue to fluctuate around the upper first level between t4 and t5. Canister loading may continue to decrease between t4 and t5, and may reach the threshold 413. In response to the canister loading remaining above the threshold 413, the purge valve may be adjusted away from the open second position towards the closed first position. The purge flow rate may therefore begin to decrease from the upper third level P2. In response to the decrease in purge flow rate, the position of the mixing valve may be towards the closed first position away from the open second position at t5.

Between t5 and t6, the desired engine torque may continue to decrease. In response to the decrease in desired engine torque, the throttle valve may remain in the closed first position. The manifold vacuum may begin to decrease near t6 as engine cylinders (e.g., engine cylinder 30 shown in FIGS. 1A and 1B) may slow significantly. Canister loading may fluctuate just below the threshold 413. In response to the canister loading decreasing below the threshold 413, the purge valve may continue to be adjusted away from the open second position towards the closed first position. The purge flow rate may therefore continue to decrease from the upper third level P2 past the intermediate second level P1, to the lower first level P0 between t5 and t6. In response to the decrease in purge flow rate, the position of the mixing valve may continue to be adjusted towards the closed first position away from the open second position.

At t6, the engine may be turned off. Thus, the desired engine torque may be approximately zero. Thus, the throttle may be fully closed at t6, and the manifold vacuum may be approximately zero since the engine may not be running. In response to the engine being turned off, the purge valve may be closed, but the mixing valve may be opened. However, in other examples, the mixing valve may remain in the closed first position at an engine off event. Due to the engine being off, and the purge valve being closed, the purge flow rate may remain at the lower first level P0. However, fuel vapors may be generated in a fuel tank (e.g., fuel tank 20 shown in FIGS. 1A and 1B) and may be released to the canister at t6. Thus, the canister loading may begin to increase above the threshold 413 t6.

Between t6 and t7, the engine may be off and/or a refueling event may occur. As such the desired engine torque may remain at the lower first level which may be approximately zero. Thus, the throttle may be fully closed between t6 and t7, and the manifold vacuum may be approximately zero since the engine may not be running. However, ambient temperature, and/or pressure in the fuel tank may cause fuel vapor generation in the fuel tank. The fuel vapors may be routed to the canister, and as such, the canister loading may steadily increase while the engine is off between t6 and t7. The purge valve may remain fully closed, and as such the purge flow rate may remain at the lower first level P0. Further the mixing valve may remain in the open position. However, in other examples it should be appreciated that the mixing valve may be held in the fully closed first position between t6 and t7.

At t7, the engine may be turned on, and as such the desired engine torque may increase above the lower first level, but may remain below the threshold 403. As such the throttle may be adjusted to the closed first position. Manifold vacuum may begin to increase above the lower second level and canister loading may continue to increase above the threshold 413. In response to the increasing canister loading at t7, the purge valve may be adjusted away from the closed first position. Due to the opening of the purge valve at t7, the purge flow rate may increase above the lower first level P0. However, since the purge flow rate may be just above the lower first level P0 at t7, the mixing valve may be adjusted to the closed first position to increase turbulence in the airflow entering the canister. Said another way, since the purge flow rate through the canister at t7 may not be sufficient to flow through the entire volume of the canister, the mixing valve may be adjusted to the closed first position to increase turbulence in the airflow entering the canister. In this way, flow through the canister may be more even, and therefore the purging efficiency of the canister may be increased.

Between t7 and t8, the desired engine torque may increase, but may remain below the threshold 403. In response to the desired torque remaining below the threshold 403, the throttle may remain closed. As such, the manifold vacuum may increase to the upper first level, and may continue to fluctuate around the upper first level between t7 and t8. Canister loading may begin to decrease between t7 and t8, but may remain above the threshold 413. In response to the canister loading remaining above the threshold, the purge valve may be adjusted to the fully open second position, and may remain in the open second position between t7 and t8. Due to the opening of the purge valve, and the intake manifold vacuum fluctuating around the upper first level, the purge flow rate may increase from the lower first level P0 up to the upper third level P2, and may remain at P2 between t7 and t8. In response to the purge flow rate increasing to P2, the mixing valve may be adjusted to the open second position, and may be held in approximately the open second position between t7 and t8.

At t8, the desired engine torque may increase above the threshold 403, and in response to the desired torque increasing above the threshold 403, the throttle may be opened at t8. In response to the opening of the throttle, the manifold vacuum may begin to decrease from the upper first level at t8. Canister loading may continue to decrease at t8, but may remain above the threshold 413. In response to the canister loading remaining above the threshold, the purge valve may be held in the open second position at t8. However, due to the decrease in manifold vacuum level, the purge flow rate may begin to decrease from the upper third level P2 at t8. In response to the decrease in purge flow rate at t8, the mixing valve may be adjusted away from the open second position towards the closed first position.

Between t8 and t9, the desired engine torque may continue to increase above the threshold 403. As such, the throttle may be adjusted with increasing deflection towards the open second position away from the closed first position between t8 and t9, and as a result, the manifold vacuum may continue to decrease from upper first level to the lower second level. Canister loading may continue to decrease due to purging of the canister from opening of the purge valve, but may remain above the threshold 413. Therefore, the purge valve may remain open between t8 and t9, to continue purging of the canister. Because of the manifold vacuum level decreasing to the lower second level, the purge flow rate may decrease to approximately the intermediate second level P1. In response to the decrease in purge flow rate, the mixing valve may be adjusted with increasing deflection towards the closed first position away from the open second position between t8 and t9.

At t9, the desired engine torque may continue to increase above the threshold 403, and as such, the throttle may be fully opened at t9. The manifold vacuum may therefore remain at the lower second level at t9. Reductions in the canister loading may begin to taper off at t9, and as such the canister loading may stop decreasing at t9. In response to the canister loading not decreasing below the threshold 413, the purge valve may remain open at t9, but may begin to be closed, as the desired engine torque continues to increase. Due to the closing of the purge valve, the purge flow rate may begin to decrease at t9. In response to the purge flow rate decrease below the intermediate second level P1, and the canister loading not decreasing at t9, the mixing valve may begin to be adjusted back and forth between two or more positions at t9 to increase turbulence of air entering the canister.

Between t9 and t10, the desired engine torque may fluctuate above the threshold 403. As such, the throttle may remain fully open between t9 and t10, and as a result, the manifold vacuum may fluctuate around the lower second level. The canister loading may remain above the threshold, between t9 and t10, but due to the high desired torque and low intake manifold vacuum, the purge valve may be adjusted with increasing deflection away from the open second position towards the closed first position. As such, the purge flow rate may decrease from the intermediate second level P1, to the lower first level P0 between t9 and t10. In response to the decrease purge flow rate, and canister loading remaining above the threshold 413, the mixing valve may be adjusted back and forth between a more open position and a more closed position. Thus, between t9 and t10, the actuator may alternate between rotating the mechanical linkage coupled to mixing valve clockwise and counterclockwise, so that the mixing valve may be displaced to a more open and then more closed position. Pivoting and/or rotating of the mixing valve back and forth, may disrupt airflow entering the canister, and may increase turbulence in the air entering the canister. Increasing the turbulence may increase the uniformity of flow within the canister, and therefore increasing the purging efficiency of the canister.

At t10, the desired torque may begin to decrease, but may remain above the threshold 403. In response to the decrease in desired engine torque, the throttle valve may be adjusted away from the open second position towards the closed first position. Due to the turbulence created by the adjusting of the mixing valve between t9 and t10, the canister loading may be reduced to the below the threshold 413 at t10. In response to the canister loading decreasing below the threshold at t10, the purge valve may be fully closed. As such, the purge flow rate may decrease to the lower first level P0 which may be approximately zero, and the mixing valve may be adjusted towards the fully closed first position in response to the decreased purge flow rate.

Between t10 and t11, the desired torque may continue to decrease to the threshold 403. In response to the decrease in desired engine torque, the throttle valve may be adjusted with increasing deflection away from the open second position towards the closed first position between t10 and t11. Due to the closing of the throttle valve, the manifold vacuum may continue to increase from the lower second level to the upper first level between t10 and t11. The canister load may remain below the threshold 413 between t10 and t11 and as such, the purge valve may remain in the closed first position. Due to the purge valve remaining in the closed first position, the purge flow rate may fluctuate around the lower first level. Specifically, the purge flow rate may be approximately zero. The mixing valve may remain in the closed first position in response to the purge flow rate remaining around zero.

At t11, the desired torque may decrease below the threshold 403. In response to the desired engine torque decreasing below the threshold, the throttle valve may be adjusted to the closed first position at t11. Due to the closing of the throttle valve, the manifold vacuum may approach and reach the upper first level. The canister load may remain below the threshold 413, and as such, the purge valve may remain in the closed first position. Due to the purge valve remaining in the closed first position, the purge flow rate may fluctuate around the lower first level. Specifically, the purge flow rate may be approximately zero. The mixing valve may remain in the closed first position in response to the purge flow rate remaining around zero.

After t11, the desired torque may continue to decrease below the threshold 403. In response to the desired engine torque decreasing below the threshold, the throttle valve may be kept in the closed first position. Due to the closing of the throttle valve, the manifold vacuum may continue to fluctuate around the upper first level. The canister load may remain below the threshold 413, and as such, the purge valve may remain in the closed first position. Due to the purge valve remaining in the closed first position, the purge flow rate may fluctuate around the lower first level. Specifically, the purge flow rate may be approximately zero. The mixing valve may remain in the closed first position in response to the purge flow rate remaining around zero.

In this way, a vehicle system may include an EVAP system for purging fuel vapors stored in a fuel vapor canister to an intake manifold of the vehicle system. To increase the purging efficiency of the fuel vapor canister, a mixing valve may be positioned in a fresh air line upstream of the canister. During purging operation, one or more of a vent valve, and a canister purge valve may be opened to draw in fresh, ambient air through the canister, to the intake manifold. The position of the mixing valve may be adjusted to increase turbulence in the airflow entering the canister. As air enters the fresh air line and flows towards the canister, airflow may be divided into two conduits in the fresh air line. One of the conduits may include the mixing valve, while the other conduit may provide an unrestricted flow path for air to the canister. Specifically, the valve may be a butterfly valve, where an opening formed by an edge of the valve may be increased by adjusting the valve away from a closed first position towards an open second position. Thus, when the valve is in the closed first position, air may only flow through the conduit that does not include the mixing valve. However, when the mixing valve is not in the closed first position, air may flow through both of the conduits in the fresh air line.

The position of the valve may be adjusted based on an estimated purging efficiency which may be estimated based on outputs from an oxygen sensor positioned downstream of the canister. Specifically, an amount of fuel vapors in air flowing by the oxygen sensor may be estimated based on changes in the oxygen concentration estimated based on outputs from the sensor. Increases in fuel vapor desorption from the canister may result in decreases in the oxygen concentration in the gasses sample by the oxygen sensor. Based on feedback from the oxygen sensor, the position of the valve may be adjusted to increase fuel vapor desorption and therefore canister purging efficiency. If the purging efficiency increases in response to adjusting of valve to a first position, the position of the valve may be maintained. Otherwise, the valve may continue to be adjusted to different positions, until the purging efficiency increases.

In some examples, when intake manifold vacuum level are sufficiently high, purge flow rates through the canister may be greater than a threshold, and the mixing valve may be adjusted towards the open second position. However, when purge flow rates are below the threshold, due to one or more of decreases in intake manifold vacuum levels, opening of a throttle, closing of the purge valve, etc., the mixing valve may be adjusted towards the closed first position, to increase turbulence in the air entering the canister. In this way, dispersion and/or commingling of the gasses entering the canister may be increased, and as such fuel vapor desorption and canister purging efficiency may be increased.

In one representation, a system for an engine may comprise a fuel vapor canister, a mixing valve positioned in a fresh air line upstream of the vapor canister, and an actuator physically coupled to the mixing valve for adjusting a position of the mixing valve to increase turbulence in air entering the vapor canister. In a first example of the system, the mixing valve may be adjustable between a closed first position where air does not flow past the mixing valve, and an open second position where air does flow past the mixing valve. An amount of turbulence in air entering the vapor canister may increase with increasing deflection of the mixing valve towards the closed first position and away from the open second position. In a second example of the system, the adjusting the position of the mixing valve may be based on an amount of fuel vapor desorption from the fuel vapor canister, where the amount of vapor desorption may be determined based on outputs from an oxygen sensor positioned downstream of the canister between the canister and an intake manifold of the engine. In a third example of the system, the position of the mixing valve may be adjusted to increase turbulence in air entering the vapor canister in response to decreases in the amount of vapor desorption. In a fourth example of the system, the position of the mixing valve may be adjusted to increase turbulence in air entering the canister in response to one or more of decreases in an intake manifold vacuum, opening of a throttle, and decreases in an airflow rate through the canister. In a fifth example of the system, the mixing valve may be a butterfly valve comprising a pivotable plate, and where an opening formed between an edge of the plate and the fresh air line may be adjusted by adjusting the position of the plate. In a sixth example of the system, the system may additionally or alternatively comprises a rotatable rod which may be physically coupled at a first end to the plate, and at an opposite second end to the actuator, where the actuator may adjust the position of the plate by rotating the rod. In a seventh example of the system, the fresh air line may be open at a first end to ambient air and may be coupled at an opposite second end to the canister for providing fluidic communication there-between, and where the fresh air line may be divided into two conduits fluidically separated by a wall. In an eighth example of the system, the mixing valve may be positioned in only one of the conduits of the fresh air line for regulating airflow through said conduit to the canister. In a ninth example of the system, the actuator may be electromechanical, and the actuator may adjust the position of the mixing valve in response to signals received from a controller.

In another representation, a method for an engine may comprise, during purging of a fuel vapor canister: adjusting a position of a mixing valve coupled in a fresh air line between the fuel vapor canister and atmosphere, to adjust a ratio of airflow through a first conduit relative to a second conduit of the fresh air line, based on one or more of an intake manifold vacuum level and a purging efficiency of the canister. In a first example of the method, the mixing valve may be adjustable between a closed first position and an open second position, and where the ratio of air flowing through the first conduit relative to the second conduit may increase with increasing deflection of the mixing valve away from the open second position towards the closed first position. In a second example of the method, the adjusting of the mixing valve may comprise moving the mixing valve towards the closed first position in response to decreases in the purging efficiency of the canister. In a third example of the method, the adjusting of the mixing valve may comprise moving the mixing valve towards the closed first position in response to decreases in the intake manifold vacuum level. In a fourth example of the method, the purging efficiency of the canister may be estimated based on outputs from an oxygen sensor positioned downstream of the canister. In a fifth example of the method the adjusting the position of the mixing valve may comprise maintaining the position of the valve in response to increases in the purging efficiency, and otherwise adjusting the mixing valve to a more closed position. In a sixth example of the method, the adjusting the position of the mixing valve may comprise oscillating the plate between two or more positions in response to one or more of decreases in the intake manifold vacuum level and purging efficiency.

In another representation, an engine system may comprise an engine including an intake manifold, a fuel vapor canister fluidically coupled to the intake manifold via a purge line for purging fuel vapors thereto, a fresh air line fluidly coupled to the canister and open to ambient air for drawing said ambient air into the canister during purging of the canister, the fresh air line comprising two parallel conduits fluidically separated by a wall, a first mixing valve positioned in one of the conduits of the fresh air line, and a controller with computer readable instructions for adjusting a position of the mixing valve during purging of the canister to increase flow uniformity in the canister in response to outputs received from an oxygen sensor positioned in the purge line. In a first example of the engine system, the engine system may further comprise an actuator which may be in electrical communication with the controller and may be physically coupled to the mixing valve for adjusting the position of the mixing valve in response to signals received from the controller. In a second example of the engine system, the engine system may include one or more or each of a second mixing valve positioned in the purge line downstream of the canister, for increasing an amount of turbulence in air entering the intake manifold from the purge line.

As such, a technical effect of increasing fuel vapor desorption and therefore purging efficiency of a fuel vapor canister is achieved by adjusting a position of a mixing valve positioned upstream of the canister. Adjusting the position of the mixing valve may increase turbulence of airflow entering the canister, and therefore may increase flow uniformity throughout the entire volume of the canister. Said another way, the commingling of gasses within the canister and dispersion of gasses in the canister may be increased by increasing turbulence in the air entering the canister. As such, a greater amount of fuel vapors may be desorbed by the canister.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine comprising:

a fuel vapor canister;

a mixing valve positioned in a fresh air line upstream of the vapor canister, wherein the mixing valve occupies only a portion of a cross-sectional area of the fresh air line such that the mixing valve still permits airflow through the fresh air line even in a fully closed first position; and an actuator physically coupled to the mixing valve for adjusting a position of the mixing valve to increase turbulence in air entering the vapor canister responsive to sensed operating conditions.

2. The system of claim 1, wherein the mixing valve is adjustable between the fully closed first position where air does not flow past the mixing valve but does still flow through the fresh air line, and an open second position where air does flow past the mixing valve, and where an amount of turbulence in air entering the vapor canister increases with increasing deflection of the mixing valve towards the fully closed first position and away from the open second position.

3. The system of claim 1, wherein the adjusting the position of the mixing valve is based on an amount of fuel vapor desorption from the vapor canister, where the amount of vapor desorption is determined via an electronic controller based on outputs from an oxygen sensor positioned downstream of the vapor canister between the vapor canister and an intake manifold of the engine.

4. The system of claim 3, wherein the position of the mixing valve is adjusted to increase turbulence in air entering the vapor canister in response to decreases in the determined amount of vapor desorption.

5. The system of claim 1, wherein the position of the mixing valve is adjusted to increase turbulence in air entering the vapor canister in response to one or more of decreases in an intake manifold vacuum, opening of a throttle, and decreases in an airflow rate through the vapor canister.

6. The system of claim 1, wherein the mixing valve is a butterfly valve comprising a pivotable plate, and where an opening formed between an edge of the plate and the fresh air line is adjusted by adjusting a position of the plate.

7. The system of claim 6, further comprising a rotatable rod physically coupled at a first end to the plate, and at an opposite, second end to the actuator, where the actuator adjusts the position of the plate by rotating the rod.

8. The system of claim 1, wherein the fresh air line is open at a first end to ambient air and is coupled at an opposite, second end to the vapor canister for providing fluidic communication there-between, and where the fresh air line is divided into two conduits fluidically separated by a wall.

9. The system of claim 8, wherein the mixing valve is positioned in only one of the conduits of the fresh air line for regulating airflow through said conduit to the vapor canister.

10. The system of claim 1, wherein the actuator is electromechanical, and where the actuator adjusts the position of the mixing valve in response to signals received from a controller.

11. A method for an engine comprising:

during purging of a fuel vapor canister:

adjusting a position of a mixing valve coupled in a fresh air line between the fuel vapor canister and atmosphere, to adjust a ratio of airflow through a first conduit relative to a second conduit of the fresh air line, based on an intake manifold vacuum level and a purging of the canister.

12. The method of claim 11, wherein the mixing valve is adjustable between a closed first position and an open second position, and where the ratio of airflow through the first conduit relative to the second conduit increases with increasing deflection of the mixing valve away from the open second position towards the closed first position.

13. The method of claim 12, wherein the adjusting comprises moving the mixing valve towards the closed first position in response to decreases in a purging efficiency of the canister.

14. The method of claim 12, wherein the adjusting comprises moving the mixing valve towards the closed first position in response to decreases in the intake manifold vacuum level.

15. The method of claim 11, wherein the purging includes a purging efficiency of the canister estimated based on outputs from an oxygen sensor positioned downstream of the canister.

16. The method of claim 11, wherein the adjusting the position of the mixing valve comprises maintaining the position of the mixing valve in response to increases in a purging efficiency, and otherwise adjusting the mixing valve to a more closed position.

17. The method of claim 11, wherein the adjusting the position of the mixing valve comprises oscillating a plate between two or more positions in response to one or more of decreases in the intake manifold vacuum level and purging efficiency.

18. An engine system, comprising:

an engine including an intake manifold;

a fuel vapor canister fluidically coupled to the intake manifold via a purge line for purging fuel vapors thereto;

a fresh air line fluidly coupled to the canister and open to ambient air for drawing said ambient air into the canister during purging of the canister, the fresh air line comprising two parallel conduits fluidically separated by a wall;

a first mixing valve positioned in one of the conduits of the fresh air line; and a controller with computer readable instructions for:

adjusting a position of the mixing valve during purging of the canister to increase flow uniformity in the canister in response to outputs received from an oxygen sensor positioned in the purge line.

19. The engine system of claim 18, further comprising an actuator in electrical communication with the controller and physically coupled to the mixing valve for adjusting the position of the mixing valve in response to signals received from the controller.

20. The engine system of claim 18, further comprising a second mixing valve positioned in the purge line downstream of the canister, for increasing an amount of turbulence in air entering the intake manifold from the purge line.

* * * * *